US011602943B2

(12) United States Patent
Ito et al.

(10) Patent No.: US 11,602,943 B2
(45) Date of Patent: Mar. 14, 2023

(54) RECORDING APPARATUS

(71) Applicant: SEIKO EPSON CORPORATION, Tokyo (JP)

(72) Inventors: Tatsuya Ito, Shiojiri (JP); Haruki Miyasaka, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/235,678

(22) Filed: Apr. 20, 2021

(65) Prior Publication Data

US 2021/0331502 A1 Oct. 28, 2021

(30) Foreign Application Priority Data

Apr. 23, 2020 (JP) ..... JP2020-076567

(51) Int. Cl.
*B41J 29/17* (2006.01)
*B41J 11/70* (2006.01)

(52) U.S. Cl.
CPC ..... *B41J 29/17* (2013.01); *B41J 11/706* (2013.01)

(58) Field of Classification Search
CPC ..... B41J 29/17
See application file for complete search history.

(56) References Cited

U.S. PATENT DOCUMENTS 5,225,853 A * 7/1993 Kobayashi ..... B41J 29/17 346/104
2009/0003906 A1 1/2009 Takeuchi et al.
2017/0113476 A1* 4/2017 Hara ..... B41J 29/17

FOREIGN PATENT DOCUMENTS

| | | |
|---|---|---|
| JP | 2002-128306 | 5/2002 |
| JP | 2009-001403 | 1/2009 |
| JP | 2009-007139 | 1/2009 |
| JP | 2019-123599 | 7/2019 |

* cited by examiner

*Primary Examiner* — Scott A Richmond
(74) *Attorney, Agent, or Firm* — Workman Nydegger

(57) ABSTRACT

A printer includes a feeding roller, a cleaning member, a holder, a main stacker, and a motor unit. The cleaning member cleans the feeding roller. The holder supports the feeding roller and is provided so as to be movable between a cleaning position and a retreat position. The main stacker moves the holder from the retreat position to the cleaning position. The motor unit is provided so as to be able to perform switching between driving of the feeding roller and driving of the main stacker. The motor unit rotates the feeding roller when the holder is positioned at the cleaning position.

13 Claims, 22 Drawing Sheets

RECORDING APPARATUS

The present application is based on, and claims priority from JP Application Serial Number 2020-076567, filed Apr. 23, 2020, the disclosure of which is hereby incorporated by reference herein in its entirety.

BACKGROUND

1. Technical Field

The present disclosure relates to a recording apparatus.

2. Related Art

An image recording apparatus of JP-A-2009-007139 includes a second tray that is slid relative to a main tray, an arm that supports a feeding roller, and a cleaning member provided on the second tray. As a user slides the second tray, the arm changes posture between a first posture and a second posture. In a state where the arm is in the second posture, the feeding roller comes into pressure contact with the cleaning member.

With the configuration of JP-A-2009-007139, the user should slide the second tray to perform cleaning, which may require the labor of the user. Further, since a new driving source is required to automatically slide the second tray, the number of components of the recording apparatus may increase.

SUMMARY

According to an aspect of the present disclosure, a recording apparatus includes: a medium contact section that is rotatably provided and comes into contact with a medium; a cleaning section that cleans the medium contact section; a support section that supports one of the medium contact section and the cleaning section; a movement section that moves the support section between a cleaning position at which the cleaning section cleans the medium contact section and a retreat position at which the cleaning section and the medium contact section are separated from each other; and a driving section that is configured to perform switching between driving of the medium contact section and driving of the movement section, in which the driving section rotates the medium contact section when the support section is positioned at the cleaning position.

According to another aspect of the present disclosure, a recording apparatus includes: a recording section that is performs recording on a medium and moves in a medium width direction; a medium contact section that is rotatably provided and comes into contact with the medium; a cleaning section that cleans the medium contact section; a support section that supports the cleaning section and is configured to move between a cleaning position at which the cleaning section cleans the medium contact section, and a retreat position at which the cleaning section and the medium contact section are separated from each other; a first mechanism section that moves the support section to the cleaning position; a second mechanism section that rotates the medium contact section; and a driving section that generates a driving force of the medium contact section and the cleaning section, and includes a transfer portion that transfers the driving force to one of the first mechanism section and the second mechanism section, the driving section configured to switch whether the transfer portion transfers the driving force to the first mechanism or to the second mechanism by bringing the transfer portion and the recording section into contact with each other to perform switching between driving of the first mechanism section and driving of the second mechanism section, in which the driving section rotates the medium contact section when the support section is positioned at the cleaning position.

DESCRIPTION OF EXEMPLARY EMBODIMENTS

Figure 1:
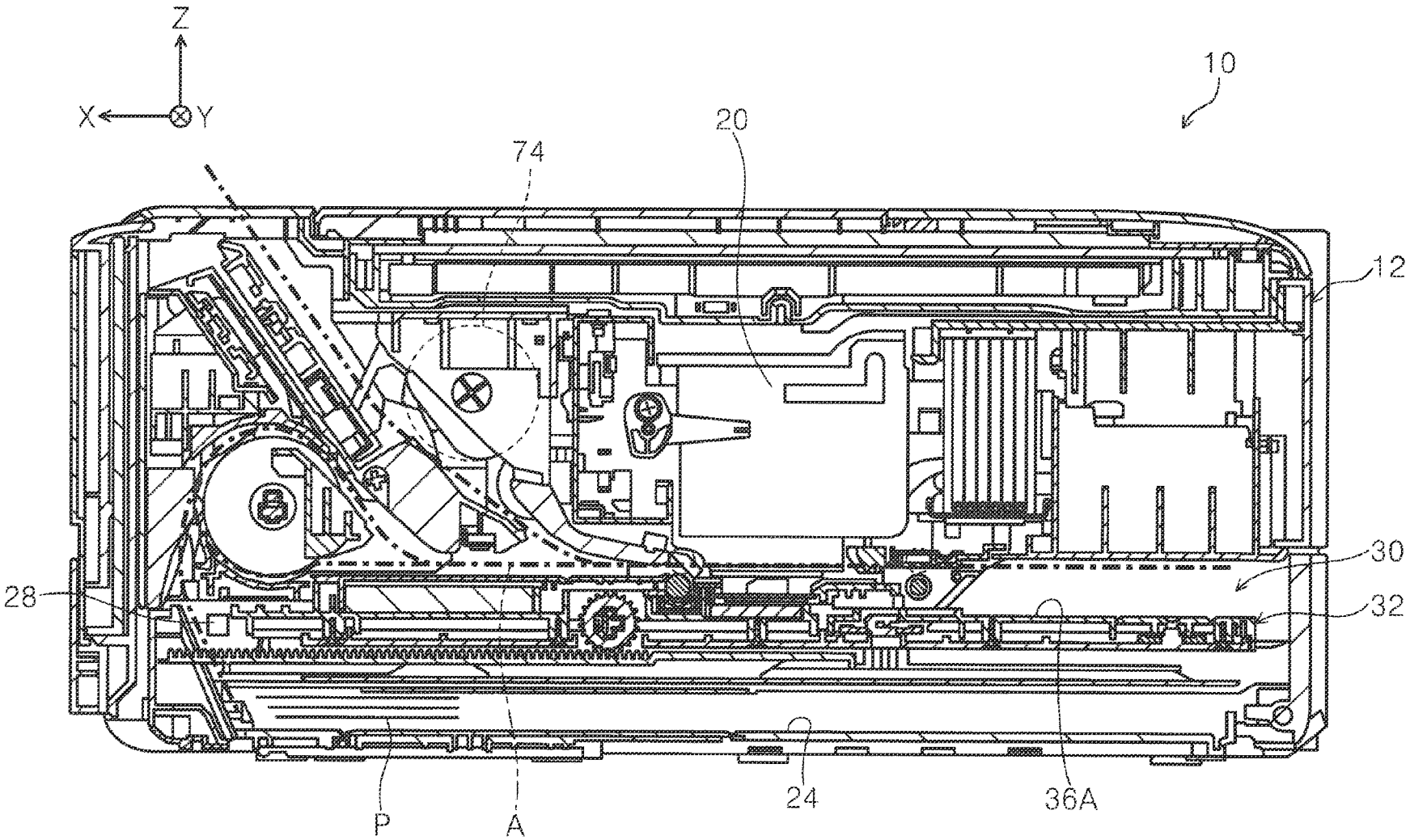
FIG. 1 is a schematic view of a printer according to Embodiment 1.

Hereinafter, the present disclosure will be schematically described.

A recording apparatus according to a first aspect includes: a medium contact section that is rotatably provided and comes into contact with a medium; a cleaning section that cleans the medium contact section; a support section that supports one of the medium contact section and the cleaning section; a movement section that moves the support section between a cleaning position at which the cleaning section cleans the medium contact section and a retreat position at which the cleaning section and the medium contact section are separated from each other; and and a driving section that is configured to perform switching between driving of the medium contact section and driving of the movement section, in which the driving section rotates the medium contact section when the support section is positioned at the cleaning position.

According to the present aspect, when the support section is positioned at the retreat position, as the movement section is driven by the driving section, the support section is moved to the cleaning position by the movement section. By doing so, the cleaning section can clean the medium contact section.

Here, as the medium contact section rotates by the driving section, the medium contact section is cleaned by the cleaning section. As such, since the movement section is automatically driven by the driving section, a user need not move the movement section, such that it is possible to reduce the labor of the user.

In addition, since both the movement section and the medium contact section are driven by one driving section, a new driving source is not required, such that it is possible to suppress the number of components of the recording apparatus from increasing.

According to a second aspect, in the recording apparatus according to the first aspect, the support section supports the medium contact section.

According to the present aspect, since the medium contact section is moved, and the cleaning section is not moved, it is possible to use the cleaning section having a relatively large size.

According to a third aspect, in the recording apparatus according to the second aspect, the movement section is a mounting section on which the medium is mounted and which is moved in a set direction, and the mounting section switches a position of the support section in an intersecting direction that intersects the set direction by being moved in the set direction.

According to the present aspect, it is possible to switch the position of the support section in the intersecting direction without using a member separate from the mounting section.

According to a fourth aspect, in the recording apparatus according to the third aspect, the mounting section switches the position of the support section in the intersecting direction by coming into contact with the support section in the set direction.

According to the present aspect, it is possible to switch the position of the support section without changing a moving direction of the mounting section from the set direction.

According to a fifth aspect, in the recording apparatus according to the fourth aspect, the mounting section has a cut portion opened in the set direction, and the support section switches the position of the support section in the intersecting direction by coming into contact with an edge of the cut portion.

According to the present aspect, since a part of the support section can be disposed inside the cut portion, it is possible to efficiently use an internal space of the apparatus.

According to a sixth aspect, in the recording apparatus according to the fifth aspect, a guiding surface that guides the support section in the intersecting direction is formed at the edge of the cut portion.

According to the present aspect, since the support section is guided in the intersecting direction by coming into contact with the guiding surface, it is possible to guide the support section in the intersecting direction more easily, as compared with a configuration in which the guiding surface is not formed.

According to a seventh aspect, in the recording apparatus according to the fourth aspect, the support section is provided so as to be rotatable around an axis extending in a medium width direction intersecting the set direction and the intersecting direction, the movement section includes a cam member provided on the support section, and the mounting section has a recess portion which is opened in the intersecting direction and with which the cam member comes into contact to rotate the support section.

According to the present aspect, since the position of the support section can be changed by rotating the support section, it is possible to further suppress an increase in size of the recording apparatus in one direction, as compared with a configuration in which the support section is slid.

According to an eighth aspect, in the recording apparatus according to the seventh aspect, the recess portion is formed at an end of the mounting section in the medium width direction.

According to the present aspect, it is possible to suppress the medium and the cam member from coming into contact with each other.

According to a ninth aspect, in the recording apparatus according to the first aspect, the support section supports the cleaning section.

According to the present aspect, since the cleaning section is moved, and the medium contact section is not moved, it is possible to easily perform an operation of installing the medium contact section.

According to a tenth aspect, in the recording apparatus according to the ninth aspect, the movement section includes a recording section that performs recording on the medium, and the driving section switches a position of the support section by moving the recording section in the medium width direction.

According to the present aspect, the position of the support section is switched using movement of the recording section, and thus, it is possible to further suppress an increase in size of the recording apparatus as compared with a configuration in which the position of the support section is switched by additionally moving a component other than the recording section.

A recording apparatus according to an eleventh aspect includes: a recording section performs recording on a medium and moves in a medium width direction; a medium contact section that is rotatably provided and comes into contact with the medium; a cleaning section that cleans the medium contact section; a support section that supports the cleaning section and is configured to switch between a cleaning position at which the cleaning section cleans the medium contact section, and a retreat position at which the cleaning section and the medium contact section are separated from each other; a first mechanism section that moves the support section to the cleaning position; a second mechanism section that rotates the medium contact section; and a driving section that generates a driving force of the medium contact section and the cleaning section, and includes a transfer portion that transfers the driving force to one of the first mechanism section and the second mechanism section, the driving section configured to switch whether the transfer portion transfers the driving force to the first mechanism or to the second mechanism by bringing the transfer portion and the recording section into contact with each other, wherein the driving section rotates the medium contact section when the support section is positioned at the cleaning position.

According to the present aspect, when the support section is positioned at the retreat position, as the first mechanism section is driven by the driving section, the support section is moved to the cleaning position. Further, as the recording section and the transfer portion come into contact with each other, switching from the first mechanism section to the second mechanism section is performed, such that a driving force can be transferred to the second mechanism section. In addition, the second mechanism section is driven by the driving section to rotate the medium contact section. By doing so, the medium contact section is cleaned. As such, since the second mechanism section is automatically driven by the driving section, the user need not operate the second mechanism section, such that it is possible to reduce the labor of the user.

In addition, since both the first mechanism section and the second mechanism section are driven by one driving section, a new driving source is not required, such that it is possible to suppress the number of components of the recording apparatus from increasing.

According to a twelfth aspect, the recording apparatus according to any one of the first to eleventh aspects further includes: a medium detection section that detects whether a failure of transport of the medium occurs; and a control section that controls a switching operation of the driving section, in which the control section controls the switching performed by the driving section to cause the cleaning section to clean the medium contact section when the medium detection section detects the failure of the transport of the medium.

According to the present aspect, it is possible to suppress a contact between the medium contact section and the medium from being continued in a state where the medium contact section is not cleaned.

According to a thirteenth aspect, the recording apparatus according to the twelfth aspect further includes: a recording section that performs recording on the medium by using an ink supplied from an ink tank; and a time point detection section that detects at least one target time point selected from a time point at which a power supply of the apparatus is turned on or off, a time point at which the ink tank is replaced, and a time point at which the recording on the medium ends, in which the control section operates the driving section to cause the cleaning section to clean the medium contact section when the time point detection section detects the target time point.

According to the present aspect, since the cleaning section cleans the medium contact section at a time point at which the medium contact section does not come into contact with or hardly comes into contact with the medium, the cleaning of the medium contact section can be easily performed.

According to a fourteenth aspect, the recording apparatus according to any one of the first to eleventh aspects further includes: a recording section that performs recording on the medium by using an ink supplied from an ink tank; a time point detection section that detects at least one target time point selected from a time point at which a power supply of the apparatus is turned on or off, a time point at which the ink tank is replaced, and a time point at which the recording on the medium ends; and a control section that controls a switching operation of the driving section, in which the control section operates the driving section to cause the cleaning section to clean the medium contact section when the time point detection section detects the target time point.

According to the present aspect, since the cleaning section cleans the medium contact section at a time point at which the medium contact section does not come into contact with or hardly comes into contact with the medium, the cleaning of the medium contact section can be easily performed.

Embodiment 1

Hereinafter, a recording apparatus according to Embodiment 1 of the present disclosure will be described with reference to the accompanying drawings. FIG. 1 illustrates an appearance of a printer 10 as an example of the recording apparatus. The printer 10 is configured as an ink jet type apparatus that performs recording by ejecting an ink, which is an example of a liquid, with respect to a paper sheet P which is an example of a medium.

In an X-Y-Z coordinate system illustrated in each drawing, an X direction is an apparatus depth direction, a Y direction is an apparatus width direction, and a Z direction is an apparatus height direction. The X direction, the Y direction, and the Z direction are orthogonal to one another.

The left side in the apparatus depth direction is referred to as a +X direction, and the right side in the apparatus depth direction is referred to as a −X direction. The front side in the apparatus width direction is referred to as a +Y direction, and the back side in the apparatus width direction is referred to as a −Y direction. The upper side in the apparatus height direction is referred to as a +Z direction, and the lower side in the apparatus height direction is referred to as a −Z direction.

An operation panel 14 (see FIG. 5) operated by an operator is provided in the printer 10. The operation panel 14 is configured so that various settings for the printer 10 can be input.

Figure 5:
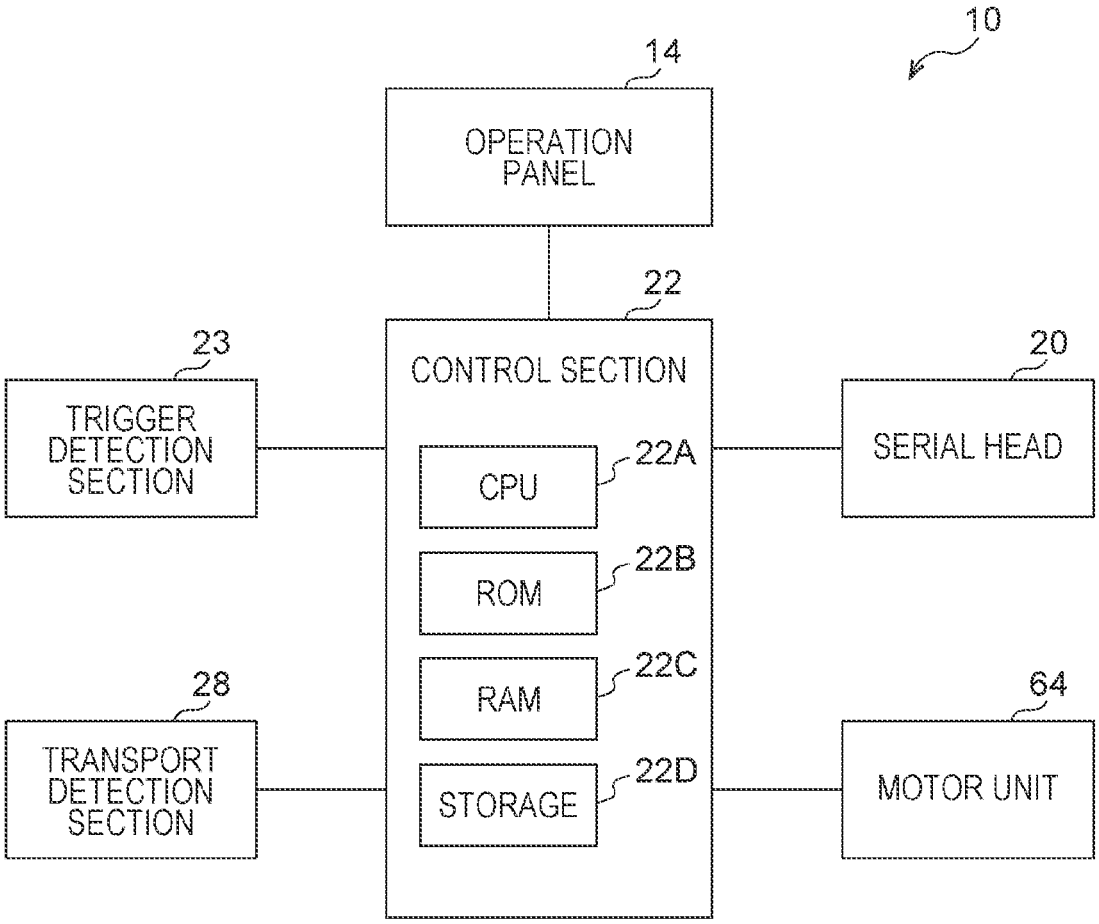
FIG. 5 is a block diagram of respective components of the printer according to Embodiment 1.

The printer 10 includes a housing 12 which is a main body, a serial head 20 which is an example of a recording section, a control section 22 (see FIG. 5), and a trigger detection section 23 (see FIG. 5).

An accommodation cassette 24 that accommodates a plurality of paper sheets P is provided at a lower portion of the housing 12. A transport path A through which the paper sheet P is transported is formed in the printer 10.

The serial head 20 includes an ink tank (not illustrated) in which the ink is stored. Further, the serial head 20 is configured as a recording head that records various information on the paper sheet P by using the ink supplied from the ink tank.

As illustrated in FIG. 5, the control section 22 includes a central processing unit (CPU) 22A, a read only memory (ROM) 22B, a random access memory (RAM) 22C, and a storage 22D, and controls transport of the paper sheet P in the printer 10 or the operation of recording various information on the paper sheet P. In addition, the control section 22 controls a switching operation of one motor unit 64 as described later.

Specifically, when a transport detection section 28 as described later detects a failure of transport of the paper sheet P, the control section 22 controls switching of the motor unit 64, thereby cleaning a feeding roller 48 as described later (see FIG. 2). Further, when the trigger detection section 23 as described later detects a target time point, the control section 22 operates the motor unit 64, thereby cleaning the feeding roller 48.

The trigger detection section 23 is an example of a time point detection section. Further, the trigger detection section 23 is coupled to the control section 22, and is configured to be able to detect at least one target time point selected from a time point at which a power supply of the printer 10 is turned on or off, a time point at which the ink tank is replaced, and a time point at which recording on the paper sheet P ends. In the present embodiment, setting is performed so that the trigger detection section 23 detects, as an example of the target time point, the time point at which recording on the paper sheet P ends. Information detected by the trigger detection section 23 is transmitted to the control section 22.

As illustrated in FIG. 1, the printer 10 includes a discharge section 30 that discharges the paper sheet P on which recording is performed, and the transport detection section 28.

The transport detection section 28 is an example of a medium detection section. Further, the transport detection section 28 detects whether or not a failure of transport of the paper sheet P to a stacker section 32 as described later occurs. In the present embodiment, as an example, the transport detection section 28 detects whether or not the paper sheet P slipped during the transport.

Specifically, the transport detection section 28 includes an optical sensor (not illustrated), and can detect a leading end of the paper sheet P in a transport direction based on whether or not light is blocked.

Although not illustrated, it is assumed that a set transport speed when the feeding roller 48 transports the paper sheet P is V (mm/s), a time point at which rotation of the feeding roller 48 starts is t1, and a time point at which the leading end of the paper sheet P is detected by the transport detection section 28 is t2. Further, it is assumed that the rotation of the feeding roller 48 and the transport of the paper sheet P start at the same time point. It is assumed that a theoretical moving distance L1 of the paper sheet P in a period from when the rotation of the feeding roller 48 starts to when the leading end of the paper sheet P is detected by the transport detection section 28 is $(t2-t1)\times V(L=(t2-t1)\times V)$.

Here, when an actual moving distance L2 of the paper sheet P in a period from when the rotation of the feeding roller 48 starts to when the leading end of the paper sheet P is detected by the transport detection section 28 is L1 (L2=L1), it is determined that the paper sheet P did not slip on the feeding roller 48. On the other hand, when the relationship expression (L2=L1) is not satisfied, it is determined that the paper sheet P slipped on the feeding roller 48. Note that, in actual implementation, allowable errors including a detection error in the transport detection section 28, a change of an outer diameter of the feeding roller 48 depending on an environment temperature, and the like are set in advance. Therefore, it is determined that the paper sheet P did not slip on the feeding roller 48, as long as the distance L2 is within an allowable error range from the distance L1.

The discharge section 30 includes the stacker section 32.

An upper surface 36A in the stacker section 32 as described later extends in the X direction when viewed from the Y direction. The X direction is an example of a set direction. The Z direction is an example of a direction intersecting the X direction, and corresponds to a direction in which the paper sheet P is loaded on the upper surface 36A.

In the following description, a direction in which the paper sheet P is transported toward the stacker section 32 is referred to as a −X direction, and a direction opposite to the −X direction is referred to as a +X direction. Further, a direction in which the paper sheet P is loaded is referred to as a +Z direction, and a direction opposite to the +Z direction is referred to as a −Z direction.

Figure 2:
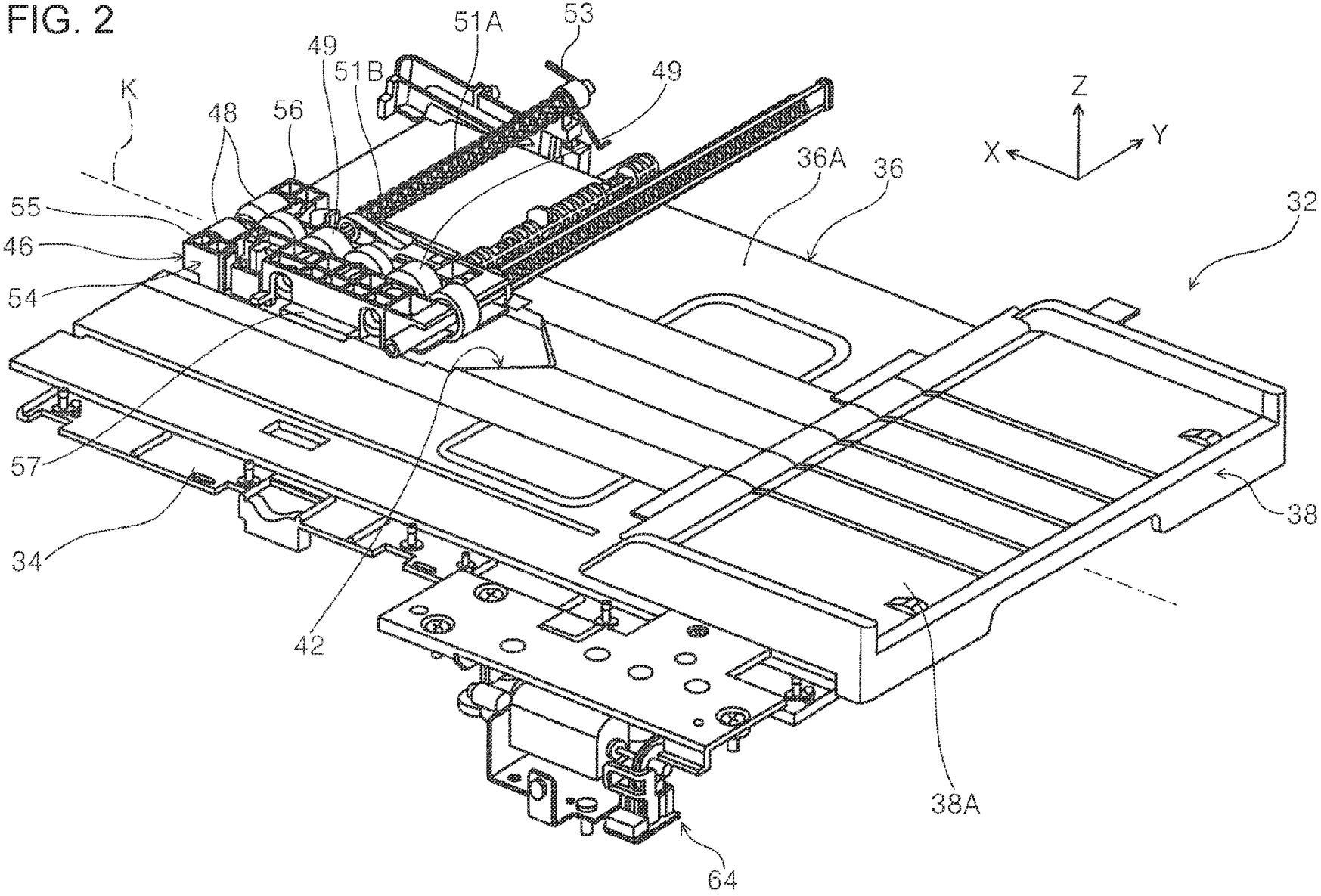
FIG. 2 is a perspective view of a discharge section according to Embodiment 1.

As illustrated in FIG. 2, the stacker section 32 includes, as an example, a guide rail 34, a main stacker 36, a sub stacker 38, a pick-up unit 46, a cleaning member 62 (see FIG. 4), and a motor unit 64.

The guide rail 34 extends straight in the X direction.

The sub stacker 38 is provided so as to be movable in the −X direction with respect to the main stacker 36.

The main stacker 36 is an example of a movement section and a mounting section. Further, the main stacker 36 is formed in a plate shape that extends along an X-Y plane when viewed from the Z direction. Specifically, the main stacker 36 is formed in a rectangular plate shape of which a dimension in the X direction is larger than a dimension in the Y direction. The main stacker 36 is provided so as to be movable in the X direction along the guide rail 34, and is moved in the X direction by being driven by the motor unit 64.

Note that the stacker section 32 is housed in the housing 12 when not being used, and is prepared for use by drawing the main stacker 36 and the sub stacker 38 from the housing 12 in the −X direction.

A +Z-direction surface of the main stacker 36 is referred to as the upper surface 36A.

A cut portion 42 opened in the +X direction is formed at a central portion of a +X-direction end of the main stacker 36 in the Y direction. Note that the paper sheet P is mounted on the upper surface 36A of the main stacker 36 and an upper surface 38A of the sub stacker 38.

A rack (not illustrated) extending along the X direction is formed at a −Y-direction end of the main stacker 36.

Figure 3:
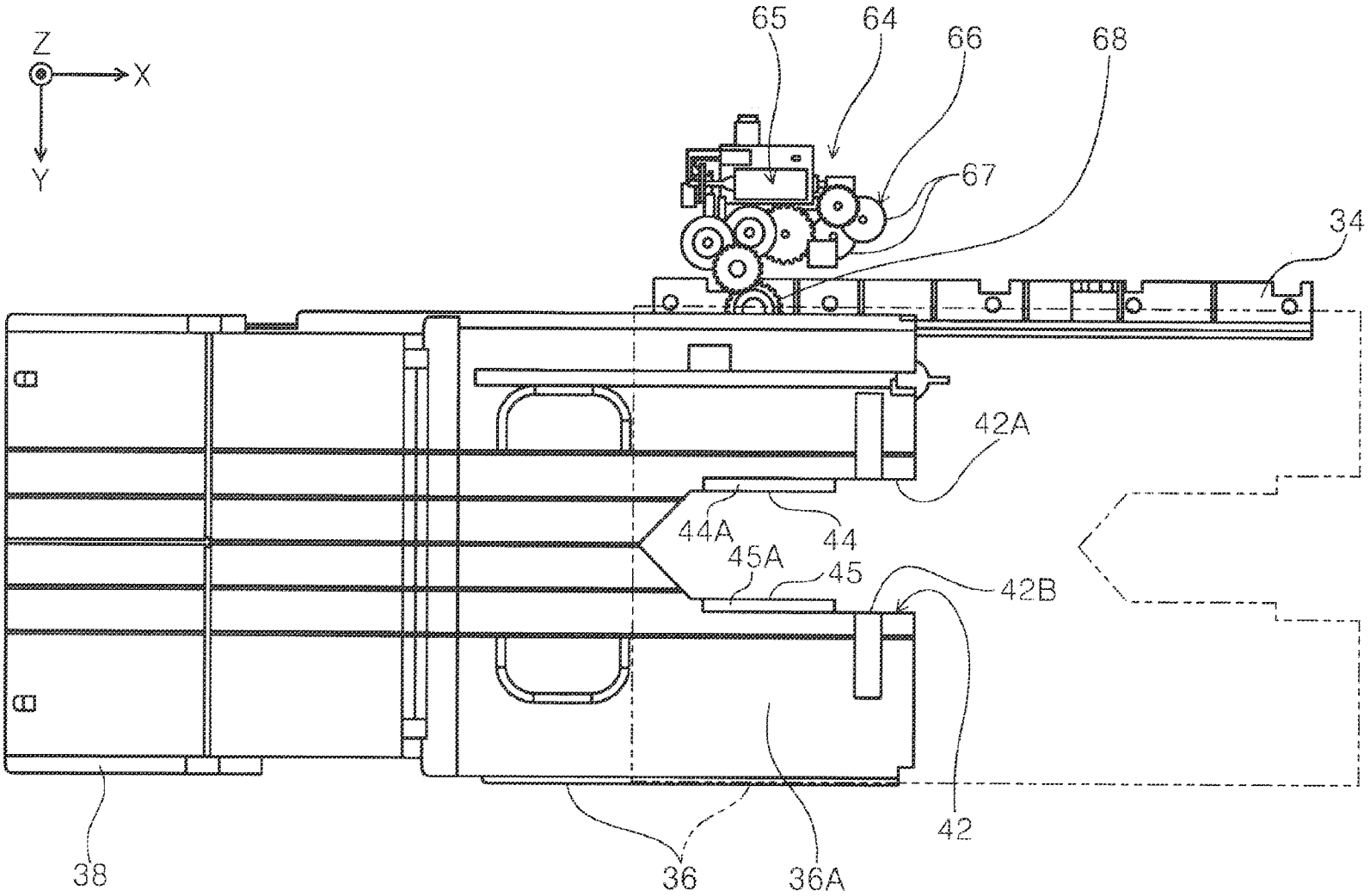
FIG. 3 is a plan view illustrating a state where a main stacker and a sub stacker are drawn according to Embodiment 1.

As illustrated in FIG. 3, as an example, the cut portion 42 has inner wall surfaces 42A and 42B facing each other while being spaced apart from each other in the Y direction and extending in the −X direction. A plate portion 44 protruding from the inner wall surface 42A in the +Y direction is formed at a part of the inner wall surface 42A in the X direction. A plate portion 45 protruding from the inner wall surface 42B in the −Y direction is formed at a part of the inner wall surface 42B in the X direction. The plate portions 44 and 45 are an example of edges of the cut portion 42. Further, the plate portions 44 and 45 are formed in a rectangular shape of which a dimension in the X direction is larger than a dimension in the Y direction when viewed from the Z direction. In addition, thicknesses of the plate portions 44 and 45 in the Z direction are smaller than a thickness of the main stacker 36 in the Z direction. In other words, upper surfaces 44A and 45A of the plate portions 44 and 45 in the +Z direction are positioned on a level lower than that of the upper surface 36A. Note that the plate portions 44 and 45 have the same configuration, and thus the plate portion 44 will be described in the following description, and a description of the plate portion 45 will be omitted.

Figure 4:
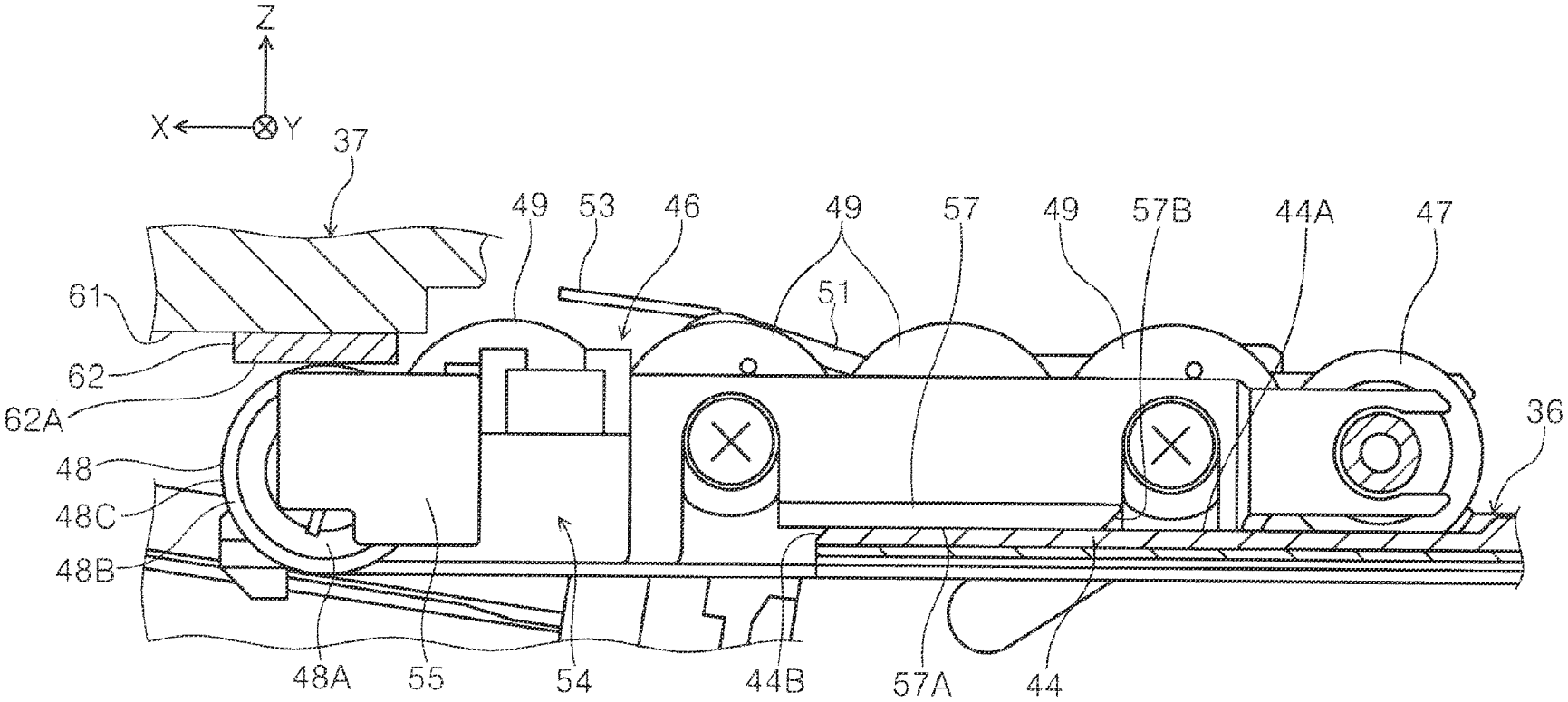
FIG. 4 is a side view of a pick-up unit according to Embodiment 1.

As illustrated in FIG. 4, a tapered surface 44B is formed at a +X-direction end of the plate portion 44.

The tapered surface 44B is an example of a guiding surface. Further, the tapered surface 44B is inclined so that a portion in the +X direction is more toward the −Z direction than a portion in the −X direction is, when viewed from the Y direction. The tapered surface 44B guides a holder 54 as described later in the +Z direction by coming into contact with an inclined surface 57B of a projecting portion 57 as described later in the +X direction. In other words, the main stacker 36 comes into contact with the holder 54 in the X direction to switch the position of the holder 54 in the +Z direction.

As such, the main stacker 36 is moved in the +X direction to come into contact with the holder 54, thereby switching the position of the holder 54 in the +Z direction.

The pick-up unit 46 includes, as an example, a shaft member 47, the feeding roller 48, a plurality of gears 49, a pressing member 51, the holder 54, and a torsion spring 53.

The shaft member 47 extends straight in the Y direction. Opposite ends of the shaft member 47 are rotatably supported by bearings provided at a bracket (not illustrated).

The plurality of gears 49 transfer a driving force of the shaft member 47 to the feeding roller 48.

The pressing member 51 includes a shaft portion 51A and a pressing portion 51B (see FIG. 2), and is energized by the torsion spring 53 to press the paper sheet P to the main stacker 36.

The feeding roller 48 is an example of a medium contact section, and is provided so as to be rotatable and be able to come into contact with the paper sheet P. Specifically, the feeding roller 48 includes a cylindrical main body portion 48A of which an axial direction is the Y direction, and a cylindrical elastic portion 48B attached to an outer circumferential surface of the main body portion 48A. The feeding roller 48 rotates by receiving a driving force through the plurality of gears 49 to feed the paper sheet P in the accommodation cassette 24.

As illustrated in FIG. 2, the holder 54 is an example of a support section, and includes holder members 55 and 56. The holder members 55 and 56 are members each extending in the X direction, and rotatably support the feeding roller 48 and the plurality of gears 49 while interposing them therebetween in the Y direction. The pressing portion 51B is housed in a part of the holder member 56. The projecting portion 57 is formed on each of the holder members 55 and 56. The projecting portion 57 projects from each of the holder members 55 and 56 in the Y direction.

As illustrated in FIG. 4, the projecting portion 57 is formed in a plate shape having a predetermined thickness in the Z direction. Further, the projecting portion 57 is formed in a rectangular shape of which a dimension in the X direction is larger than a dimension in the Y direction. A width of the projecting portion 57 in the Y direction is equal to or smaller than a width of the plate portion 44 in the Y direction, when viewed from the Z direction. A length of the projecting portion 57 in the X direction is smaller than a length of the plate portion 44 in the X direction. A lower surface 57A of the projecting portion 57 in the −Z direction is positioned at a height at which the lower surface 57A can come into contact with an upper surface 44A when the main stacker 36 is moved in the X direction.

The inclined surface 57B is formed at a −X-direction end of the projecting portion 57. The inclined surface 57B is inclined so that a portion in the +X direction is more toward the −Z direction than a portion in the −X direction is, when viewed from the Y direction.

A −X-direction end of the holder member 55 and a −X-direction end of the holder member 56 (see FIG. 2) are rotatably coupled to the shaft member 47. As such, the holder 54 can independently rotate, regardless of whether or not the shaft member 47 rotates.

A +X-direction end of the holder 54 rotatably supports the feeding roller 48. As such, the holder 54 is provided so as to be movable between a cleaning position at which a cleaning member 62 as described later can clean the feeding roller 48, and a retreat position at which the cleaning member 62 and the feeding roller 48 are separated from each other.

In other words, the main stacker 36 moves the holder 54 from the retreat position to the cleaning position, or from the cleaning position to the retreat position. Specifically, the main stacker 36 switches the position of the holder 54 in the Z direction by bringing the plate portions 44 and 45 of the cut portion 42 (see FIG. 2) into contact with the holder 54.

Note that, when the holder 54 is positioned at the retreat position, the feeding roller 48 is positioned above the accommodation cassette 24. Further, the feeding roller 48 rotates to perform an operation of feeding the paper sheet P to the transport path A.

The cleaning member 62 is an example of a cleaning section, and is attached to the lower surface 61 of the frame 37 of the housing 12 in the +Z direction. Further, the cleaning member 62 cleans the outer circumferential surface of the feeding roller 48 by rotation of the feeding roller 48 in a state where the holder 54 is positioned at the cleaning position.

As an example, the cleaning member 62 is formed of urethane and formed in a plate shape having a predetermined thickness in the Z direction. Further, the cleaning member 62 is formed in a rectangular shape of which a dimension in the Y direction is larger than a dimension in the X direction when viewed from the Z direction. A length of the cleaning member 62 in the Y direction is larger than a length of the feeding roller 48 in the Y direction. A thickness of the cleaning member 62 in the Z direction is substantially the same as a thickness of the cleaning member 62 in the X direction.

A lower surface 62A of the cleaning member 62 in the −Z direction is, for example, a flat surface extending along the X-Y plane. A part of an outer circumferential surface 48C of the feeding roller 48 comes into contact with a central portion of the lower surface 62A in the X direction in the +Z direction.

As illustrated in FIG. 3, the motor unit 64 is an example of a driving section. Further, as an example, the motor unit 64 includes a driving motor 65 and a gear portion 66.

The driving motor 65 receives power from a power supply section (not illustrated) of the printer 10 (see FIG. 1), and is operated based on an instruction from the control section 22 (see FIG. 1).

The gear portion 66 includes a plurality of gears 67, a pinion 68, and a clutch member (not illustrated). The pinion 68 meshes with the rack (not illustrated) of the main stacker 36.

The clutch member is provided so as to be couplable to or detachable from one gear 67 and a gear (not illustrated). An operation of coupling or detaching the clutch member is controlled by the control section 22. When the clutch member is coupled to the gear 67, the main stacker 36 is driven by the driving motor 65. Meanwhile, when the clutch member is coupled to the gear, the shaft member 47 (see FIG. 4) rotates by the driving motor 65, that is, the feeding roller 48 (see FIG. 4) rotates. As such, the motor unit 64 is provided so as to be able to perform switching between driving of the feeding roller 48 and driving of the main stacker 36.

Next, actions of the printer 10 of Embodiment 1 will be described with reference to FIGS. 1 to 7.

Figure 6:
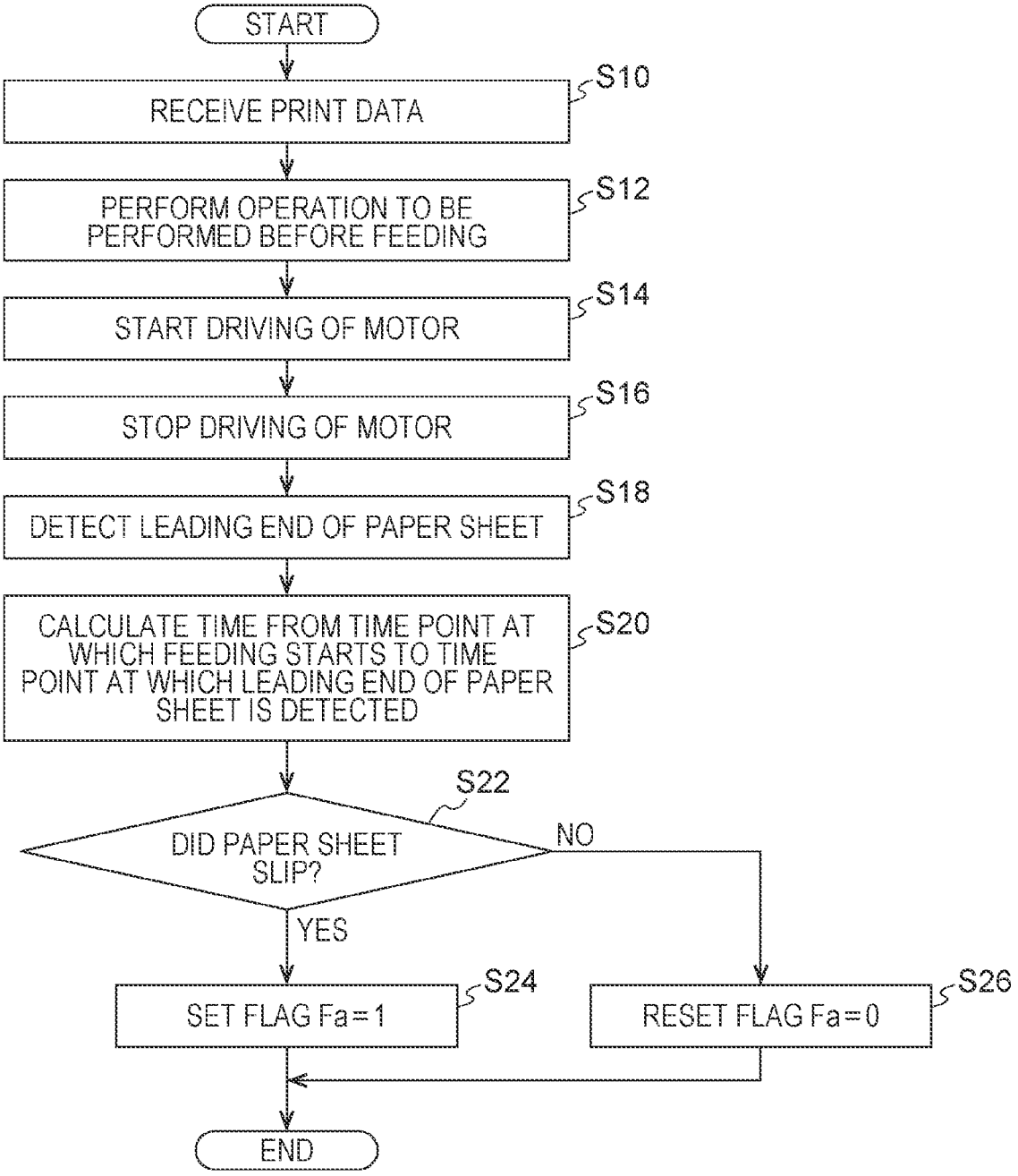
FIG. 6 is a flowchart illustrating flag setting processing based on whether or not a feeding roller slipped in the printer according to Embodiment 1.
Figure 7:
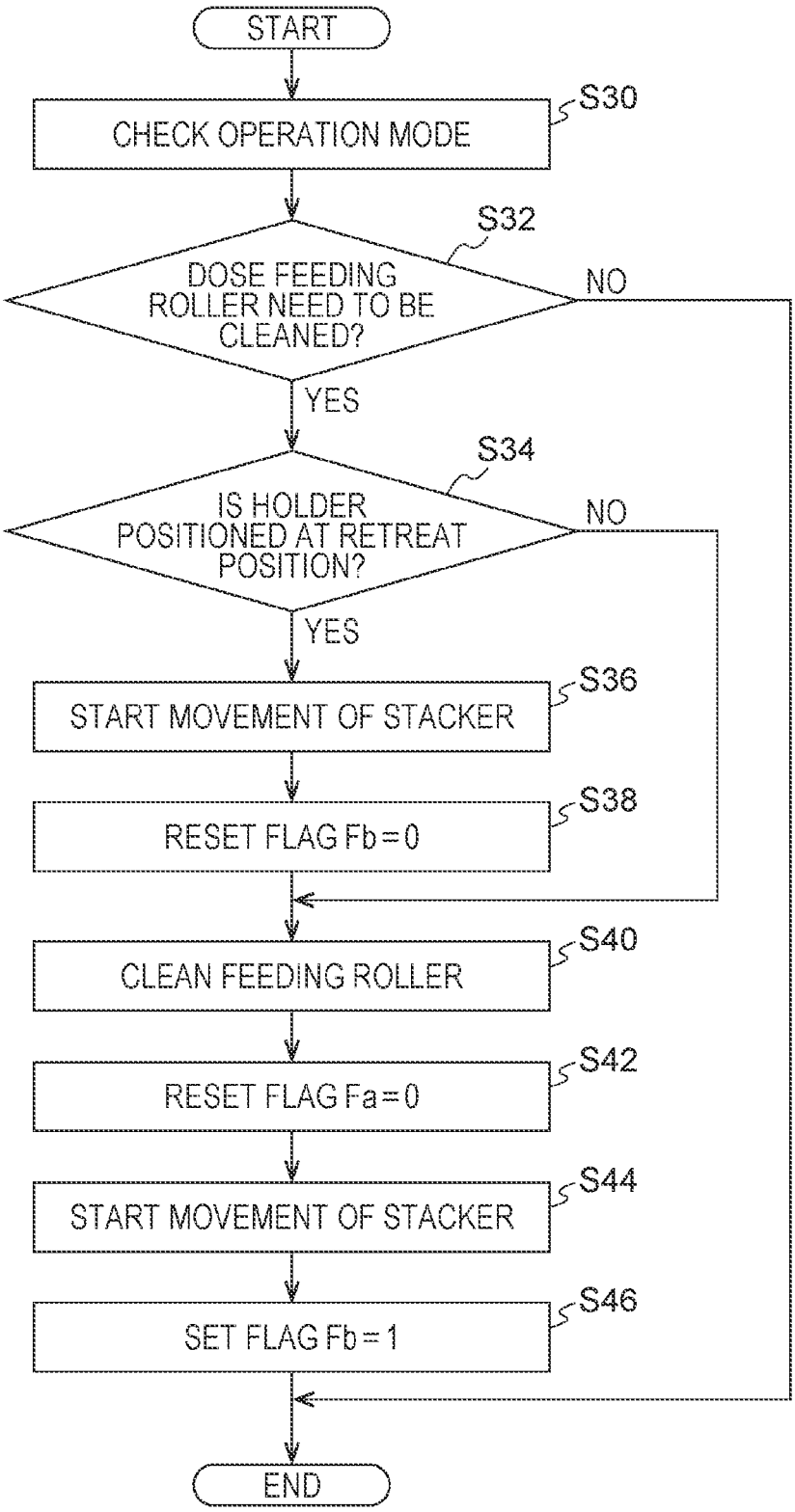
FIG. 7 is a flowchart illustrating cleaning processing for the feeding roller in the printer according to Embodiment 1.

FIG. 6 is a flowchart illustrating a flow of processing for determining whether or not the paper sheet P slipped, the processing being performed by the control section 22 (FIG. 1). FIG. 7 is a flowchart illustrating a flow of processing for cleaning the feeding roller 48, the processing being performed by the control section 22. Note that, in a description with reference to FIGS. 6 and 7, individual reference signals indicating the respective members will be omitted.

The respective processes illustrated in FIGS. 6 and 7 are performed in a manner that the CPU 22A of the control section 22 reads a processing program from the ROM 22B or the storage 22D, loads the processing program on the RAM 22C, and executes the processing program.

As illustrated in FIG. 6, in Step S10, the CPU 22A receives print data of the printer 10. Then, the CPU 22A proceeds to Step S12.

In Step S12, the CPU 22A performs an operation to be performed before feeding a paper sheet to the stacker section 32 in the printer 10. Here, as an example, an operation of drawing the stacker section 32 is performed. By doing so, the stacker section 32 is prepared for use. Then, the CPU 22A proceeds to Step S14.

In Step S14, the CPU 22A starts driving of the driving motor 65. By doing so, rotation of the feeding roller 48 starts, and the paper sheet P starts to be transported from the accommodation cassette 24. Then, the CPU 22A proceeds to Step S16.

In Step S16, the CPU 22A stops the driving of the driving motor 65 when a preset time elapses from the start of the driving of the driving motor 65. By doing so, the rotation of the feeding roller 48 is stopped, and the transport of the paper sheet P is stopped halfway. Then, the CPU 22A proceeds to Step S18.

In Step S18, the CPU 22A detects the leading end of the paper sheet P by using the transport detection section 28, and stores a time point at which the leading end of the paper sheet P is detected. Then, the CPU 22A proceeds to Step S20.

In Step S20, the CPU 22A calculates a time Δt from a time point at which the feeding starts to a time point at which the leading end of the paper sheet is detected, and calculates the above-described distance L2. Then, the CPU 22A proceeds to Step S22.

In Step S22, the CPU 22A determines whether or not the paper sheet P slipped on the feeding roller 48 by determining whether or not the distance L2 is within the allowable range having the above-described distance L1 as a median. When the paper sheet P slipped (S22: YES), the CPU 22A proceeds to Step S24. On the other hand, when the paper sheet P did not slip (S22: NO), the CPU 22A proceeds to Step S26.

In Step S24, the CPU 22A sets a flag (Fa=1). Then, the CPU 22A terminates the program.

In Step S26, the CPU 22A resets the flag (Fa=0). Then, the CPU 22A terminates the program.

In this way, flag setting based on whether or not the paper sheet P slipped on the feeding roller 48 is performed.

Next, a processing for cleaning the feeding roller 48 will be described.

As illustrated in FIG. 7, in Step S30, the CPU 22A checks an operation mode in the printer 10. Here, it is confirmed that the trigger detection section 23 detected a time point at which recording on the paper sheet P ends. Then, the CPU 22A proceeds to Step S32.

In Step S32, the CPU 22A determines whether or not the feeding roller 48 needs to be cleaned. Specifically, when the above-described flag Fa is 1 (Fa=1) (S32: YES), the CPU 22A determines that the feeding roller 48 needs to be cleaned, and proceeds to Step S34. On the other hand, when the above-described flag Fa is 0 (Fa=0) (S32: NO), the CPU 22A determines that the feeding roller 48 need not be cleaned, and terminates the program.

In Step S34, the CPU 22A determines whether or not the holder 54 is positioned at the retreat position. Here, movement of the main stacker 36 is indicated by a flag Fb, and the CPU 22A performs the determination based on a value (0 or 1) of the flag Fb. When the flag Fb is 1 (Fb=1) (S34: YES), the CPU 22A determines that the holder 54 is positioned at the retreat position and proceeds to Step S36. On the other hand, when the flag Fb is 0 (Fb=0) (S34: NO), the CPU 22A determines that the holder 54 is positioned at the cleaning position and proceeds to Step S40.

In Step S36, the CPU 22A drives the motor unit 64 to move the main stacker 36 in the +X direction. By doing so, the plate portions 44 and 45 come into contact with the projecting portion 57, and the +X-direction end of the holder 54 is moved in the +Z direction, such that the feeding roller 48 comes into contact with the cleaning member 62. Note that the sub stacker 38 is moved in the +X direction together with the main stacker 36. Then, the CPU 22A proceeds to Step S38.

In Step S38, the CPU 22A resets the flag Fb (Fb=0). Then, the CPU 22A proceeds to Step S40.

In Step S40, the CPU 22A switches a clutch of the motor unit 64 to rotate the feeding roller 48. By doing so, the outer circumferential surface of the feeding roller 48 is cleaned by the cleaning member 62. Then, the CPU 22A proceeds to Step S42.

In Step S42, the CPU 22A resets the flag Fa (Fa=0). Then, the CPU 22A proceeds to Step S44.

In Step S44, the CPU 22A drives the motor unit 64 to move the main stacker 36 in the −X direction. By doing so, the plate portions 44 and 45 are separated from the projecting portion 57, and the +X-direction end of the holder 54 is moved in the −Z direction, such that the feeding roller 48 retreats from the cleaning member 62. Then, the CPU 22A proceeds to Step S46.

In Step S46, the CPU 22A resets the flag Fb (Fb=1). Then, the CPU 22A terminates the program.

As described above, in the printer 10, when the holder 54 is positioned at the retreat position, as the main stacker 36 is driven by the motor unit 64, the holder 54 is moved to the cleaning position by the main stacker 36. By doing so, the cleaning member 62 can clean the feeding roller 48.

Here, as the feeding roller 48 rotates by the motor unit 64, the feeding roller 48 is cleaned by the cleaning member 62. As such, since the main stacker 36 is automatically driven by the motor unit 64, the user need not move the main stacker 36, such that it is possible to reduce the labor of the user.

In addition, since both the main stacker 36 and the feeding roller 48 are driven by one motor unit 64, a new driving source is not required, such that it is possible to suppress the number of components of the printer 10 from increasing.

In the printer 10, since the feeding roller 48 is moved, and the cleaning member 62 is not moved, it is possible to use the cleaning member 62 having a relatively large size.

In the printer 10, it is possible to switch the position of the holder 54 in the above-described intersecting direction without using a member separate from the main stacker 36.

In the printer 10, it is possible to switch the position of the holder 54 without changing a moving direction of the main stacker 36 from the X direction.

In the printer 10, since a part of the holder 54 can be disposed inside the cut portion 42, it is possible to efficiently use an internal space of the apparatus.

In the printer 10, since the holder 54 is guided in the Z direction by coming into contact with the tapered surface 44B, it is possible to guide the holder 54 in the Z direction more easily, as compared with a configuration in which the tapered surface 44B is not formed.

In the printer 10, it is possible to suppress a contact between the feeding roller 48 and the paper sheet P from being continued in a state where the feeding roller 48 is not cleaned.

In the printer 10, since the cleaning member 62 cleans the feeding roller 48 at a time point at which the feeding roller 48 does not come into contact with or can hardly come into contact with the paper sheet P, the cleaning of the feeding roller 48 can be easily performed.

Embodiment 2

Next, a printer 70 of Embodiment 2 will be described as an example of the recording apparatus according to the present disclosure. Note that the same components as those of the printer 10 of Embodiment 1 will be denoted by the same reference signals as those of the printer 10, and a description thereof will be omitted. In Embodiment 2, a +X direction and a −X direction are set to be reverse to those in Embodiment 1.

Figure 8:
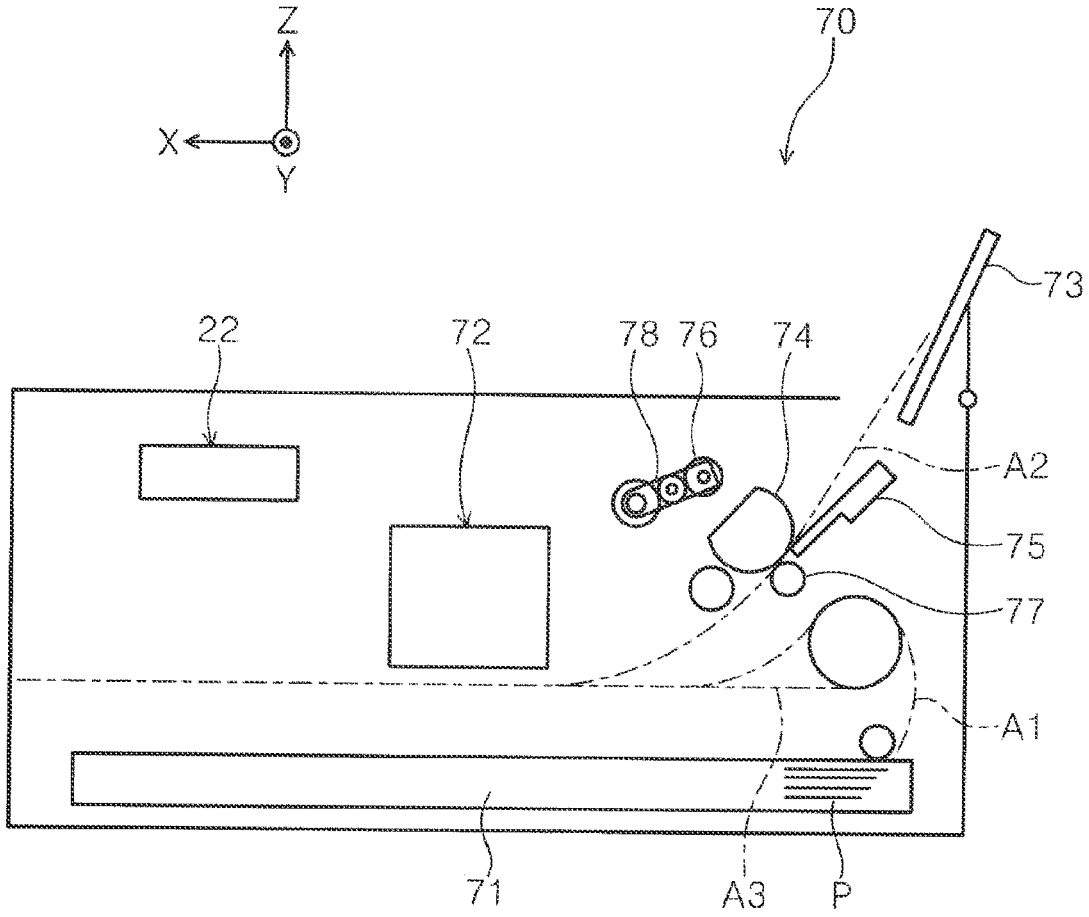
FIG. 8 is a schematic view of a printer according to Embodiment 2.
Figure 9:
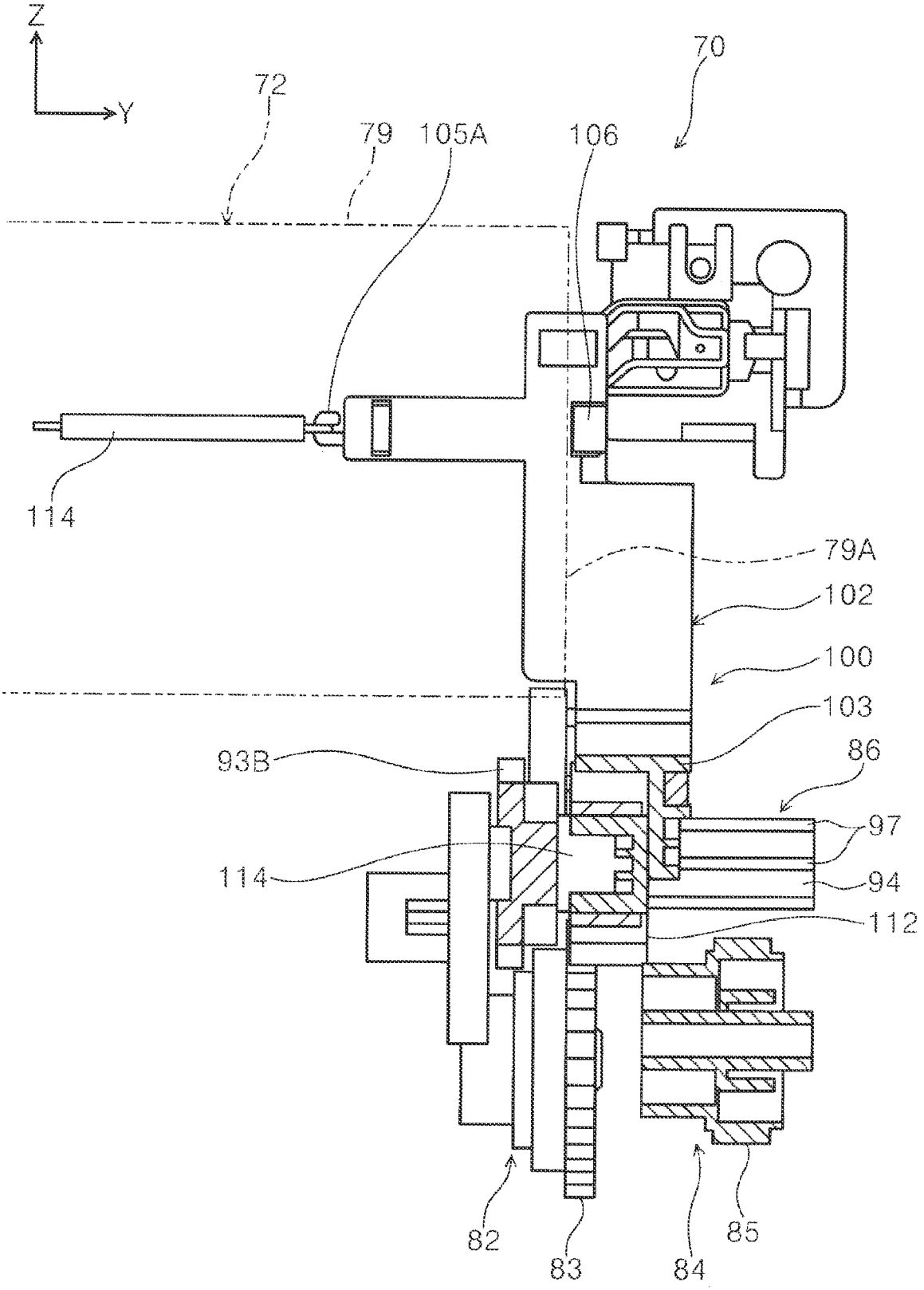
FIG. 9 is a side view of a switching member of the printer according to Embodiment 2.

FIGS. 8 and 9 illustrate the printer 70.

The printer 70 includes a recording section 72, a feeding roller 74, a cleaning roller 76, a holder 78, a first mechanism section 84, a second mechanism section 82, a motor unit 86, and a control section 22.

Further, the printer 70 includes a feeding cassette 71, a manual tray 73, a hopper 75, and a retard roller 77.

Further, in the printer 70, transport paths for the paper sheet P include a transport path A1, a manual path A2, and a reverse path A3. Through the transport path A1, the paper sheet P is transported from the feeding cassette 71 to the recording section 72. Through the manual path A2, the paper sheet P is transported from the manual tray 73 to the recording section 72. Through the transport path A3, the paper sheet P on which recording is performed by the recording section 72 is reversed.

The manual tray 73, the feeding roller 74, the hopper 75, and the retard roller 77 are disposed on the manual path A2. The feeding roller 74 and the retard roller 77 rotate in a state where the paper sheet P is interposed therebetween, thereby supplying the paper sheet P.

Note that, in an X-Y-Z coordinate system used in Embodiment 2, a Y direction is a horizontal scanning direction of the recording section 72 and a medium width direction, and an X direction is a vertical scanning direction. Further, a Z direction is a height direction of the printer 70.

As illustrated in FIG. 9, the recording section 72 is configured as a so-called serial recording unit that records various information on the paper sheet P by using an ink while performing scanning in the Y direction. Further, the recording section 72 includes a carriage and a recording head (not illustrated), and reciprocates in the Y direction by being driven by the motor unit 86 as described later. In addition, the recording section 72 is covered by a cover member 79 formed in a box shape. As an example, the cover member 79 has a side surface 79A along an X-Z plane.

Figure 10:
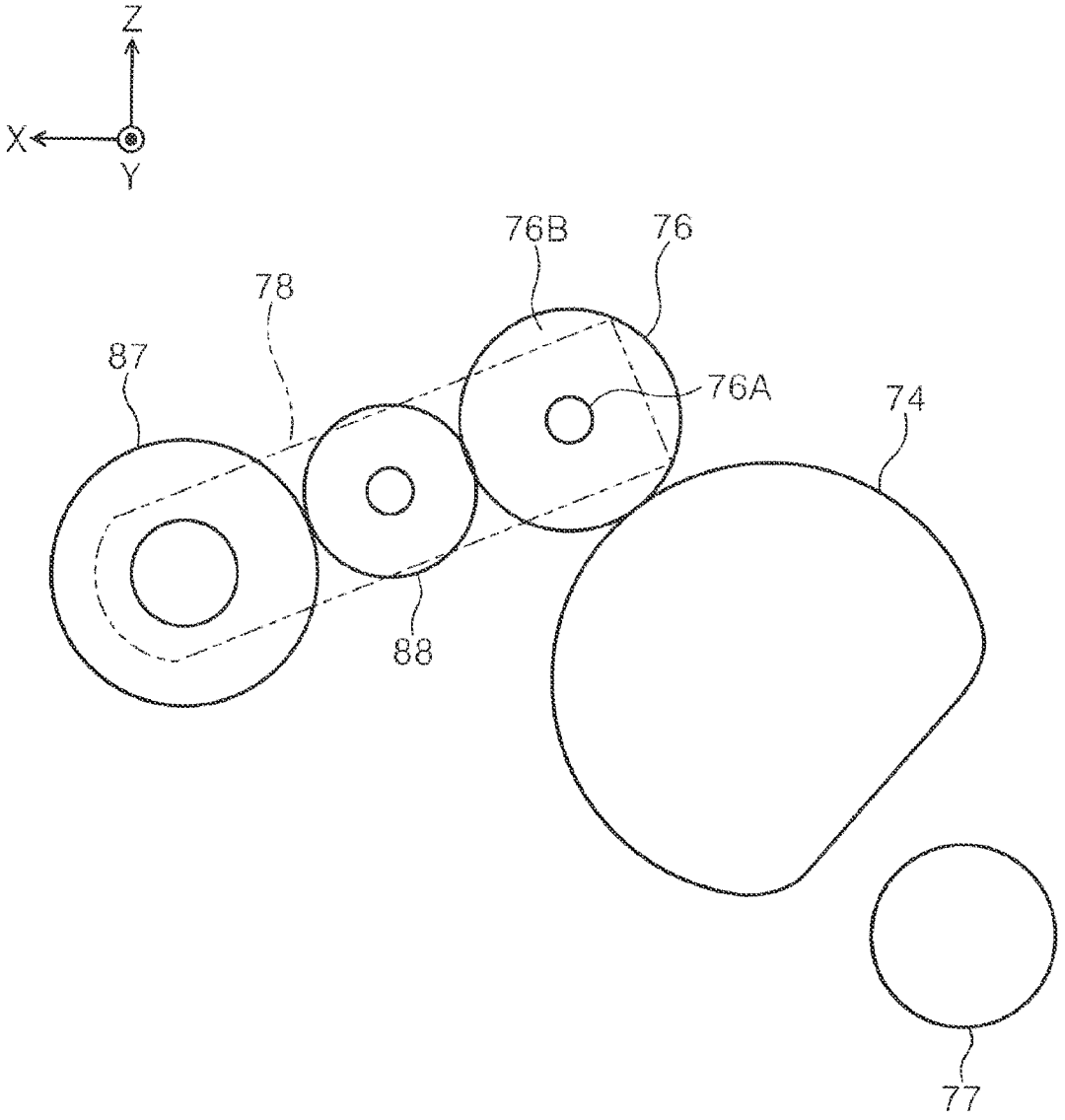
FIG. 10 is a schematic view illustrating a feeding roller and a cleaning member of the printer according to Embodiment 2.

As illustrated in FIG. 10, the feeding roller 74 is an example of the medium contact section, and is provided so as to be able to come into contact with the paper sheet P. Specifically, the feeding roller 74 is a member in which a part of a cylinder, of which an axial direction is the Y direction, in a circumferential direction, is cut. Further, the feeding roller 74 is provided so as to be rotatable based on the Y direction as the axial direction, and rotates by receiving a driving force from the second mechanism section 82 as described later, thereby feeding the paper sheet P.

The cleaning roller 76 is an example of the cleaning section, and includes a cylindrical shaft portion 76A extending in the Y direction, and an elastic portion 76B formed of urethane and attached to an outer circumferential surface of the shaft portion 76A. Further, the cleaning roller 76 cleans an outer circumferential surface of the feeding roller 74 while rotating by receiving a driving force from a planetary gear 88 as described later in a state of coming into contact with the outer circumferential surface of the feeding roller 74. Note that the rotation of the cleaning roller 76 may be stopped by cutting off the driving force from the planetary gear 88.

The holder 78 is an example of the support section, a shaft member 87, the planetary gear 88, and the cleaning roller 76 are fitted to the holder 78 in the Y direction. Note that the shaft member 87 extends in the Y direction, and rotates by the motor unit 86 (see FIG. 9) through the second mechanism section 82 as described later.

Further, the holder 78 rotatably supports the planetary gear 88 and the cleaning roller 76. In addition, the holder 78 functions as a planetary holder that rotates along the X-Z plane in conjunction with the rotation of the shaft member 87.

The planetary gear 88 rotates in conjunction with the shaft member 87, thereby rotating the cleaning roller 76.

Here, a position of the holder 78 when the cleaning roller 76 comes into contact with the feeding roller 74 and thus can perform cleaning is referred to as a cleaning position. Further, a position of the holder 78 when the cleaning roller 76 and the feeding roller 74 are separated from each other is referred to as a retreat position. That is, the holder 78 is provided so as to be movable between the cleaning position and the retreat position.

As illustrated in FIG. 9, the first mechanism section 84 includes a transfer gear 85. When receiving the driving force from the motor unit 86, the transfer gear 85 transfers the driving force to the shaft member 87 through a shaft (not illustrated) and a gear (not illustrated). The shaft member 87 transfers the driving force to move the holder 78 (see FIG. 10). As such, the first mechanism section 84 rotates the holder 78. By doing so, the holder 78 is moved to the cleaning position or the retreat position.

The second mechanism section 82 includes a transfer gear 83 and a plurality of gears (not illustrated). When receiving the driving force from the motor unit 86, the transfer gear 83 transfers the driving force to a shaft and a gear. The shaft and the gear rotate the feeding roller 74. Note that, in normal use in which the printer 70 performs a recording operation, the driving force of the motor unit 86 is transferred not only to the recording section 72, but also to the second mechanism section 82.

Figure 11:
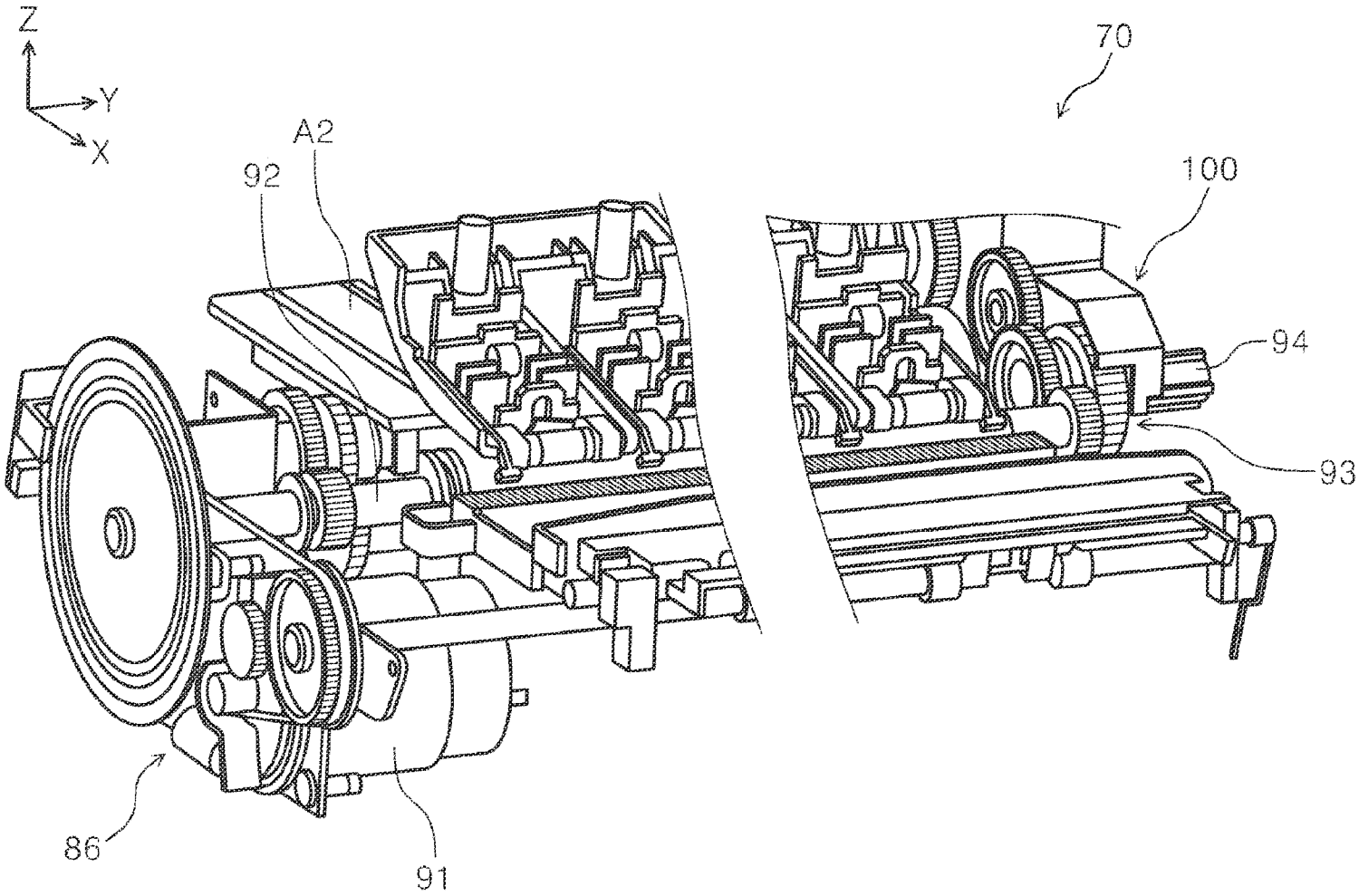
FIG. 11 is a perspective view illustrating portions including a motor unit and the like of the printer according to Embodiment 2.

As illustrated in FIG. 11, the motor unit 86 is an example of the driving section, and includes a motor main body portion 91, a shaft 92, a gear portion 93, a driving shaft 94, and a transfer portion 100. The motor main body portion 91 is disposed in the −Y direction with respect to the manual path A2. The gear portion 93, the driving shaft 94, and the transfer portion 100 are disposed in the −Y direction as the apparatus width direction with respect to the manual path A2. The shaft 92 is supported so as to be rotatable based on the Y direction as the axial direction, and transfers a driving force of the motor main body portion 91 to the gear portion 93.

Figure 12:
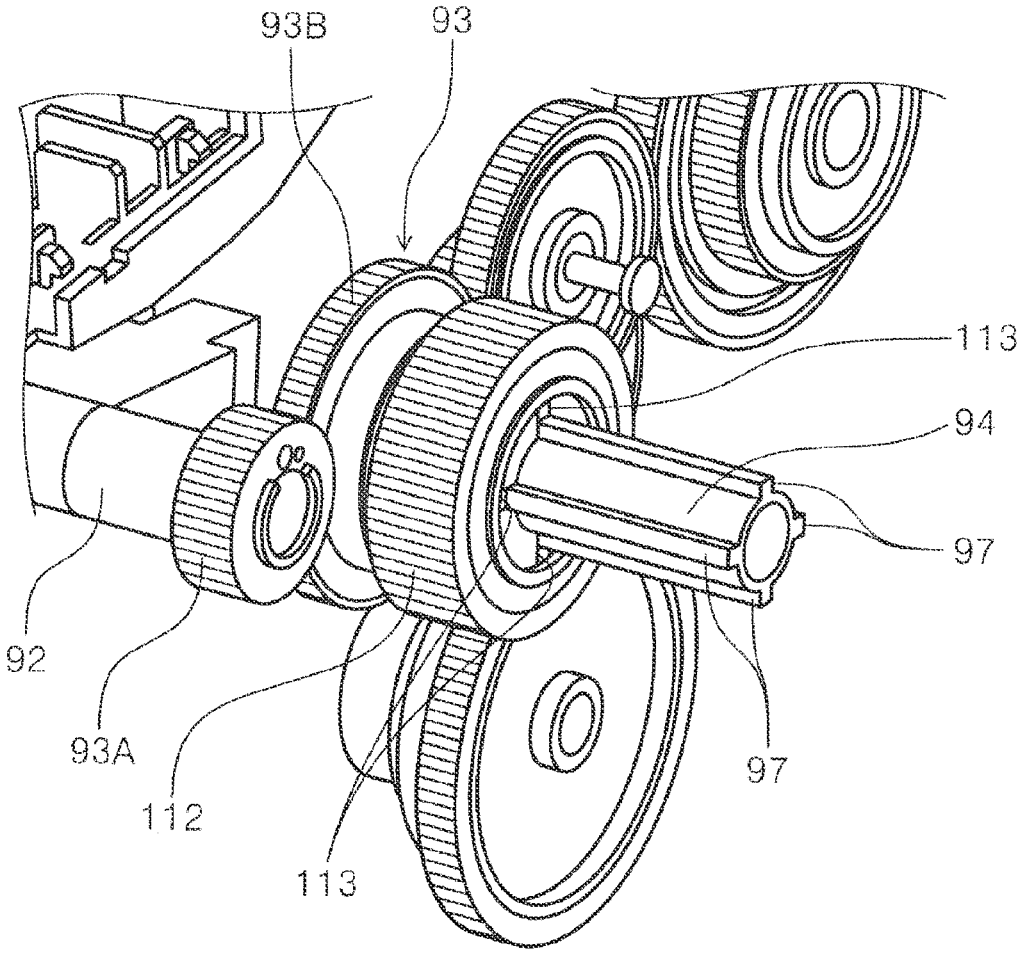
FIG. 12 is an enlarged perspective view of a part of a transfer mechanism portion of the printer according to Embodiment 2.

As illustrated in FIG. 12, the gear portion 93 includes gears 93A and 93B, and transfers the driving force transferred by the shaft 92 to the driving shaft 94.

The driving shaft 94 is supported by a bracket (not illustrated) so as to be rotatable based on the Y direction as the axial direction, and rotates integrally with the gear 93B. By doing so, the driving shaft 94 transfers the driving force to the transfer portion 100 (see FIG. 11). Note that a plurality of guide rails 97 that guide a driving gear 112 as described later in the Y direction are formed on an outer circumferential surface of the driving shaft 94.

As illustrated in FIG. 9, as an example, the transfer portion 100 includes a switching member 102, the driving gear 112, a tension spring 114, and a compression spring 116. Further, the transfer portion 100 is configured to transfer a driving force to one of the first mechanism section 84 and the second mechanism section 82.

Figure 13:
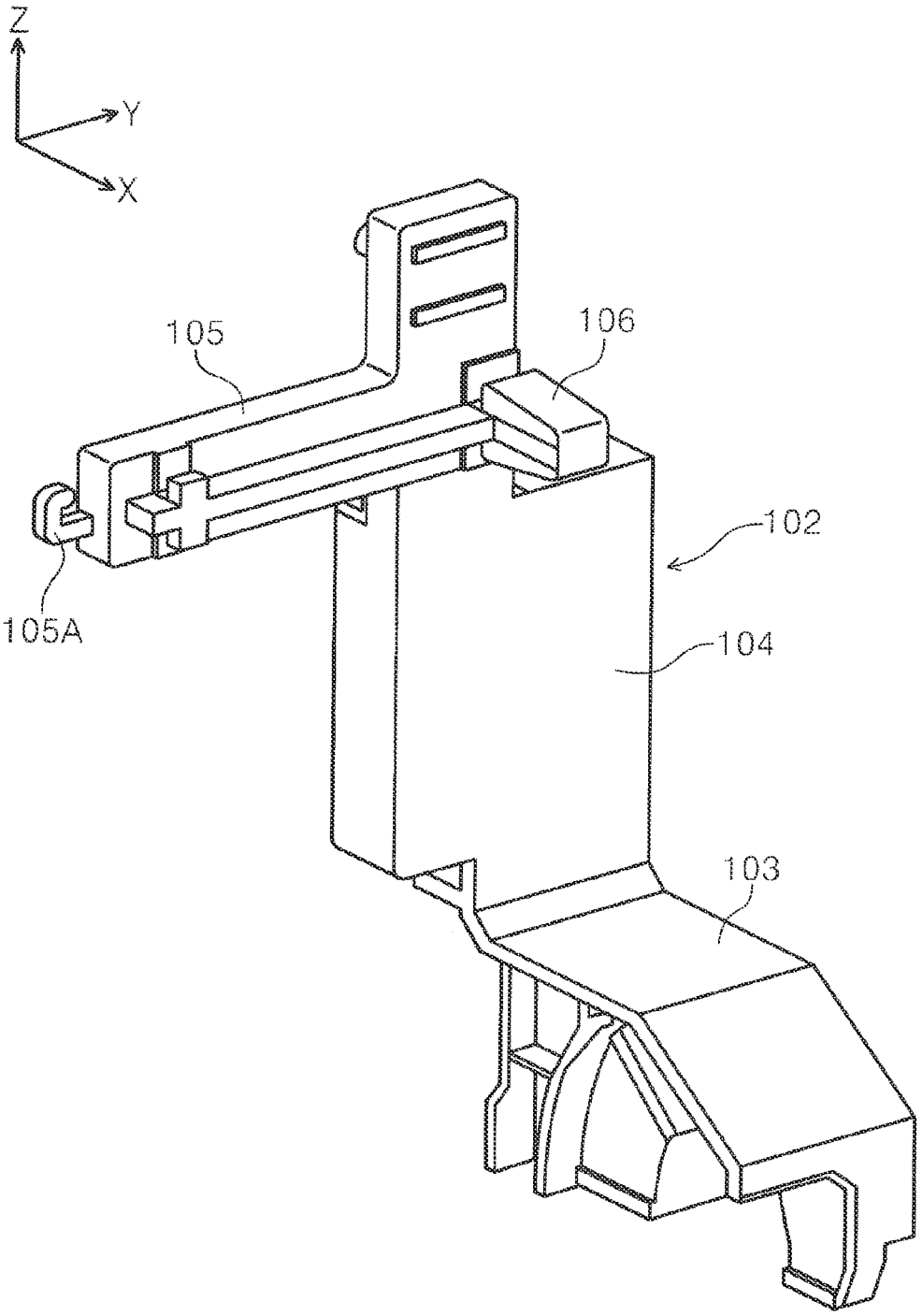
FIG. 13 is an enlarged perspective view of a switching member of the printer according to Embodiment 2.

As illustrated in FIG. 13, the switching member 102 is a member in which a base portion 103, a vertical wall portion 104, an extending portion 105, and a contact portion 106 are integrated with one another.

The base portion 103 is a portion extending in the X direction, and rotatably supports the driving gear 112 (see FIG. 12) together with the driving shaft 94 (see FIG. 12).

The vertical wall portion 104 is a portion standing upright from the base portion 103 in the +Z direction and formed in a plate shape having a predetermined thickness in the X direction.

The extending portion 105 extends from the vertical wall portion 104 in the −Y direction. A hooking portion 105A is formed on the extending portion 105.

The contact portion 106 is a portion protruding from the vertical wall portion 104 in the +X direction. Further, the contact portion 106 is disposed in the +Y direction with respect to the recording section 72 (see FIG. 9), and is disposed so as to be able to come into contact with the recording section 72 in the Y direction.

As illustrated in FIG. 9, the driving gear 112 is supported by the base portion 103 so as to be rotatable based on the Y direction as the axial direction. A plurality of grooves 113 (see FIG. 12), which are formed radially from a central portion, are formed in the driving gear 112. The guide rail 97 is inserted into the groove 113. By doing so, the base portion 103 and the driving gear 112 may integrally make a relative movement in the Y direction with respect to the driving shaft 94.

Further, the driving gear 112 is disposed so as to mesh with the transfer gear 83 when moved in the −Y direction. Further, the driving gear 112 is disposed so as to mesh with the transfer gear 85 when moved in the +Y direction.

One end of the tension spring 114 in the Y direction is attached to the bracket (not illustrated), and the other end of the tension spring 114 is hooked to the hooking portion 105A. As a result, the tension spring 114 applies a tensile force in the −Y direction to the switching member 102 when being stretched from a natural length.

The compression spring 116 is a coil spring. The driving shaft 94 is inserted into the compression spring 116. Further, the compression spring 116 is interposed between the gear 93B and the driving gear 112 in the Y direction, and applies an energizing force in the +Y direction to the driving gear 112 and the switching member 102 when being compressed.

As the switching member 102 is pulled in the −Y direction, and the driving gear 112 and the transfer gear 83 mesh with each other in a state where a part of the recording section 72 and the contact portion 106 are not in contact with each other, the motor unit 86 can transfer the driving force to the second mechanism section 82. Further, the motor unit 86 drives the recording section 72 in the Y direction.

Figure 14:
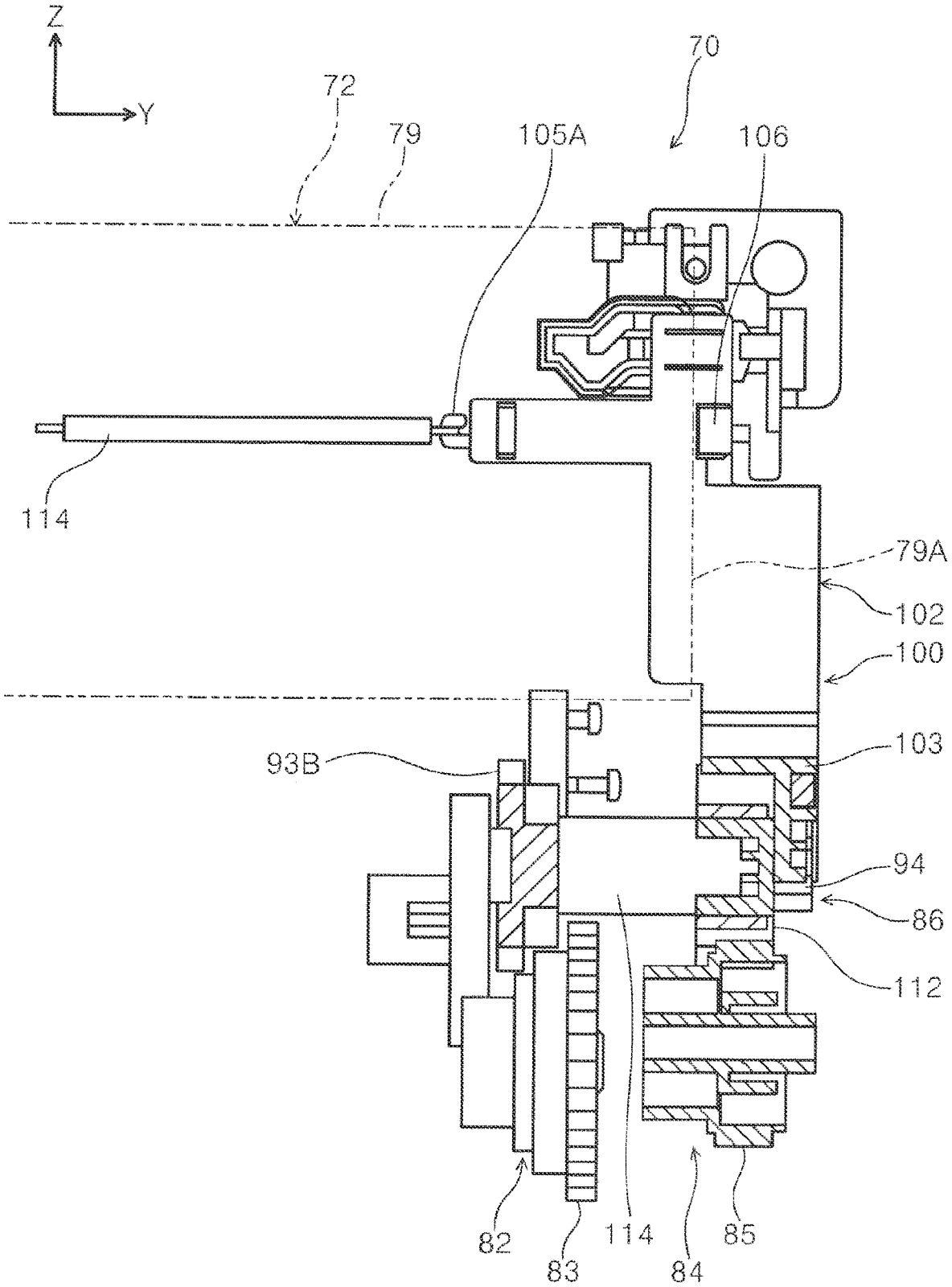
FIG. 14 is a side view of the switching member of the printer according to Embodiment 2.
Figure 15:
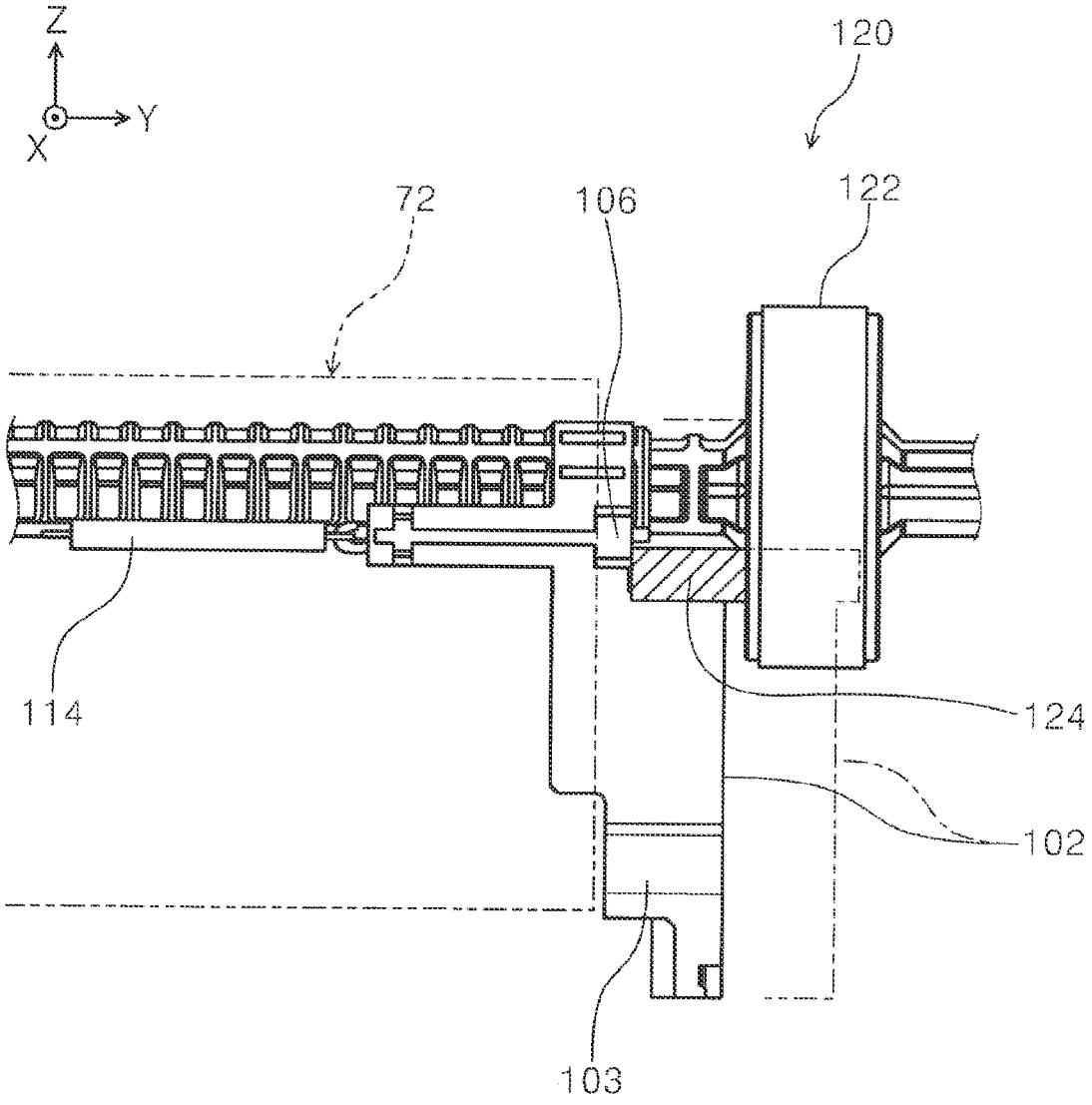
FIG. 15 is a side view illustrating a switching member and a feeding roller according to a first modified example of the printer according to Embodiment 2.
Figure 16:
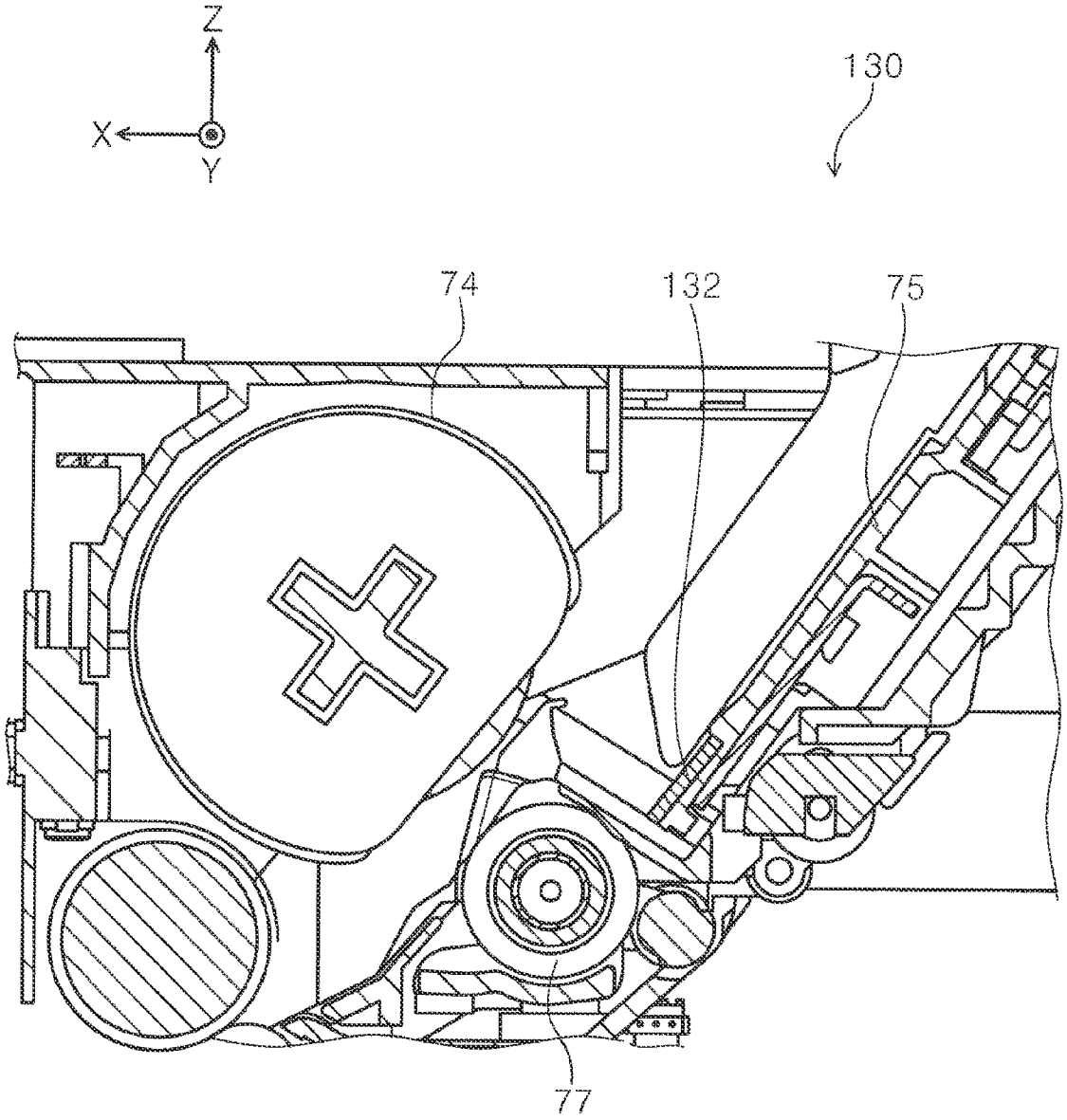
FIG. 16 is a side view illustrating a state where a cleaning member according to a second modified example of the printer according to Embodiment 2 retreats with respect to the feeding roller.
Figure 17:
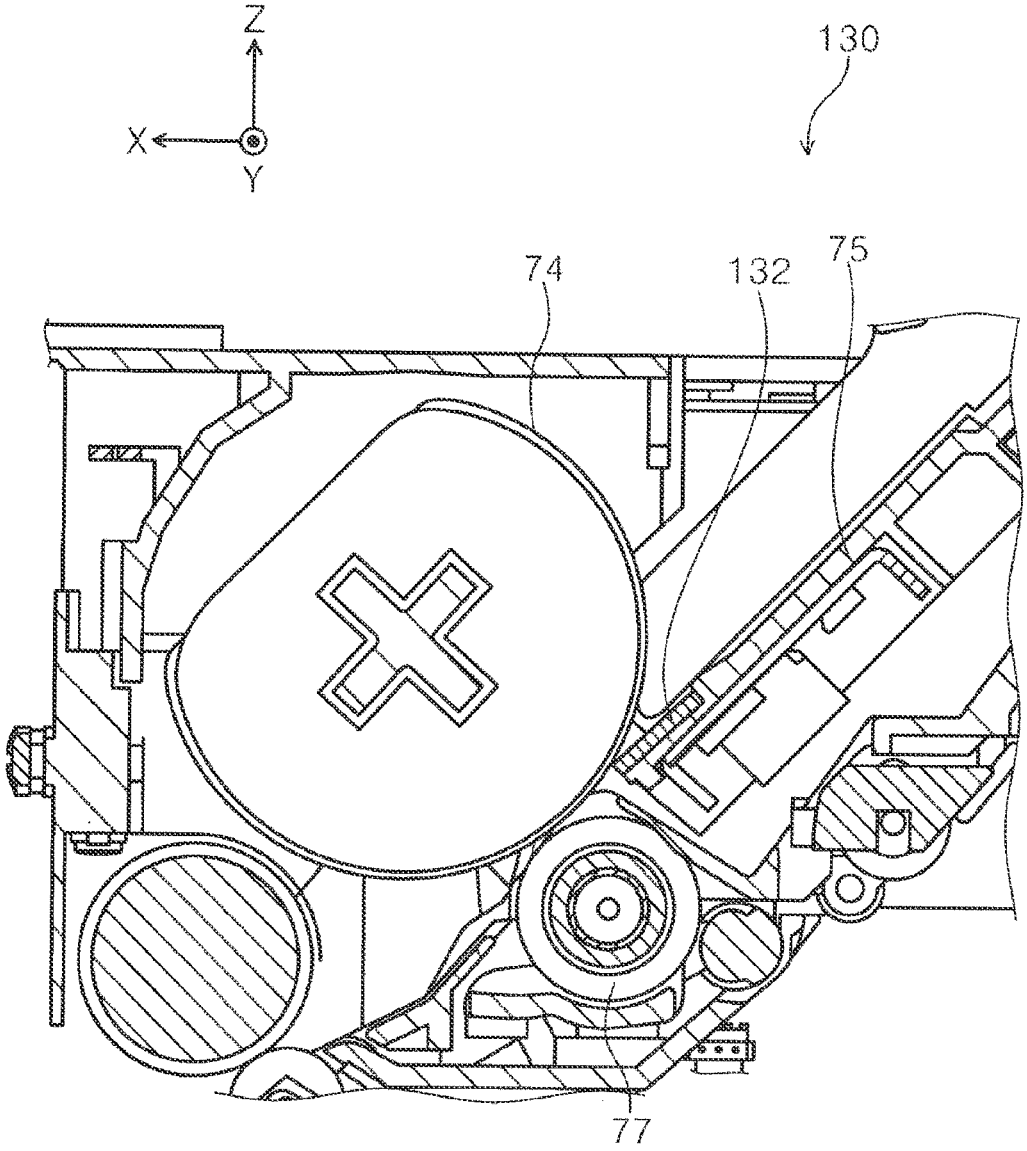
FIG. 17 is a side view illustrating a state where the cleaning member according to the second modified example of the printer according to Embodiment 2 comes into contact with the feeding roller.

As illustrated in FIG. 14, as a part of the recording section 72 and the contact portion 106 come into contact with each other, the switching member 102 is moved in the +Y direction which corresponds to the front side in the apparatus width direction, and the driving gear 112 and the transfer gear 85 mesh with each other, the motor unit 86 can transfer the driving force to the first mechanism section 84.

Next, actions of the printer 70 of Embodiment 2 will be described with reference to FIGS. 8 to 14.

In the printer 70, when the holder 78 is positioned at the retreat position, the recording section 72 is moved in the +Y direction by the motor unit 86, such that the recording section 72 and the transfer portion 100 come into contact with each other, thereby performing switching from the second mechanism section 82 to the first mechanism section 84. By doing so, the driving force can be transferred to the first mechanism section 84. Further, as the first mechanism section 84 is driven by the motor unit 86, the holder 78 is moved to the cleaning position. By doing so, the cleaning roller 76 can clean the feeding roller 74.

Here, as the recording section 72 is moved in the −Y direction by being driven by the motor unit 86, and the tensile force of the tension spring 114 is applied to the switching member 102, switching from the first mechanism section 84 to the second mechanism section 82 is performed. Further, the feeding roller 72 rotates by the motor unit 86, and the cleaning roller 76 rotates, thereby cleaning the feeding roller 72. As such, since the second mechanism section 82 is automatically driven by the motor unit 86, the user need not operate the second mechanism section 82, such that it is possible to reduce the labor of the user.

In addition, since the first mechanism section 84, the second mechanism section 82, and the recording section 72 are all driven by one motor unit 86, a new driving source is not required, such that it is possible to suppress the number of components of the printer 70 from increasing.

First Modified Example

A printer 120, which is a first modified example of Embodiment 2, will be described with reference to FIGS. 1, 8, 9, and 15. The printer 120 is an example of the recording apparatus. Note that the same components as those of the printer 70 will be denoted by the same reference signals as those of the printer 70, and a description thereof will be omitted.

The printer 120 includes a recording section 72, a transport roller 122, a cleaning member 124, a first mechanism section 84, a second mechanism section 82, a motor unit 86, and a control section 22.

The second mechanism section 82 transfers a driving force to the transport roller 122. Note that the first mechanism section 84 and the second mechanism section 82 are examples of the movement section.

The transport roller 122 is an example of the medium contact section, and is provided so as to be rotatable based on the Y direction as the axial direction. Further, the transport roller 122 is disposed so as to be positioned upstream of the recording section 72 in a direction in which the paper sheet P is transported, and comes into contact with the paper sheet P while rotating to transport the paper sheet P.

The cleaning member 124 is an example of the cleaning section, and is a member that cleans an outer circumferential surface of the transport roller 122. Further, as an example, the cleaning member 124 is formed of urethane and formed in a plate shape having a predetermined thickness in the X direction. In addition, the cleaning member 124 is attached to a part of a switching member 102. Further, when the switching member 102 is positioned at a cleaning position as described later, the cleaning member 124 is disposed so as to be able to come into contact with the outer circumferential surface of the transport roller 122 in the X direction.

In the printer 120, the switching member 102 is an example of the support section, and supports the cleaning member 124. Further, the switching section 102 is provided so as to be movable between the cleaning position at which the cleaning member 124 can clean the transport roller 122, and a retreat position at which the cleaning member 124 and the transport roller 122 are separated from each other.

Further, in the printer 120, the recording section 72 is an example of the movement section, and moves the switching member 102 from the retreat position to the cleaning position.

The motor unit 86 drives the first mechanism section 84 to move the recording section 72 in the Y direction. By doing so, the recording section 72 comes into contact with a contact portion 106 of the switching member 102. Further, the motor unit 86 switches the position of the switching member 102 from a first position connected to the first mechanism section 84 to a second position connected to the second mechanism section 82. Further, the motor unit 86 rotates the transport roller 122.

In the printer 120, since the cleaning member 124 is moved, and the cleaning member 122 is not moved, it is possible to easily perform an operation of installing the transport roller 122. Further, in the printer 120, the position of the switching member 102 is switched using movement of the recording section 72, and thus, it is possible to further suppress an increase in size of the printer 120 as compared with a configuration in which the position of the switching member 102 is switched by additionally moving a component other than the recording section 72.

Second Modified Example

A printer 130, which is a second modified example of Embodiment 2, will be described with reference to FIGS. 1, 8, 9, 16, and 17. The printer 130 is an example of the recording apparatus. Note that the same components as those of the printer 70 or 120 will be denoted by the same reference signals as those of the printer 70 or 120, and a description thereof will be omitted.

The printer 130 includes a recording section 72, a feeding roller 74, a cleaning member 132, a hopper 75, a first mechanism section 84, a second mechanism section 82, a motor unit 86, and a control section 22. The first mechanism section 84 is used for movement of the hopper 75. The second mechanism section 82 is used for rotation of the feeding roller 74.

The cleaning member 132 is an example of the cleaning section, and is a member that cleans an outer circumferential surface of the feeding roller 74. Further, as an example, the cleaning member 132 is formed of cork, and is formed as a plate-shaped friction member. In addition, the cleaning member 132 is attached to a downstream end of the hopper 75 in the direction in which the paper sheet P is transported. Further, the cleaning member 132 is disposed so as to be able to come into contact with the outer circumferential surface of the feeding roller 74.

In the printer 130, the hopper 75 is an example of the support section, and supports the cleaning member 132. Further, the hopper 75 is provided so as to be movable between a cleaning position at which the cleaning member 132 can clean the feeding roller 74, and a retreat position at which the cleaning member 132 and the feeding roller 74 are separated from each other.

In the printer 130, when the hopper 75 is positioned at the retreat position, the recording section 72 is moved in the +Y direction by the motor unit 86, such that a driving force can be transferred to the first mechanism section 84. Further, as the first mechanism section 84 is driven, the hopper 75 is moved to the cleaning position (see FIG. 17). By doing so, the cleaning member 132 can clean the feeding roller 74.

Next, as the recording section 72 is moved in the −Y direction, switching from the first mechanism section 84 to the second mechanism section 82 is performed. Further, as the second mechanism section 82 is driven by the motor unit 86, the feeding roller 74 rotates and is cleaned. As such, since the second mechanism section 82 is automatically driven by the motor unit 86, the user need not operate the second mechanism section 82, such that it is possible to reduce the labor of the user.

In addition, since both the first mechanism section 84 and the second mechanism section 82 are driven by one motor unit 86, a new driving source is not required, such that it is possible to suppress the number of components of the printer 130 from increasing.

Embodiment 3

Next, a printer 140 of Embodiment 3 will be described as an example of the recording apparatus according to the present disclosure. Note that the same components as those of the printer 10 of Embodiment 1 will be denoted by the same reference signals, and a description thereof will be omitted.

Figure 18:
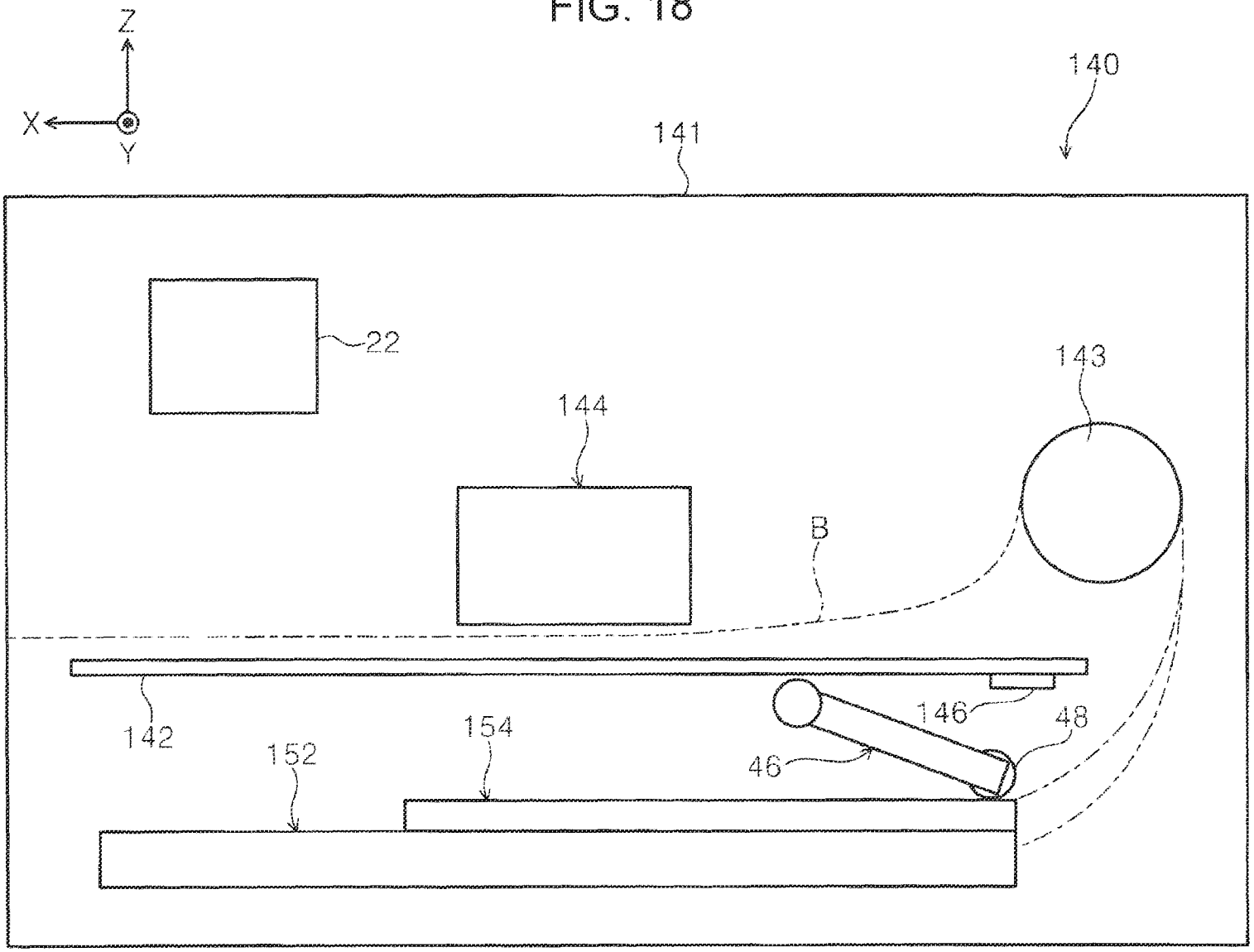
FIG. 18 is a schematic view of a printer according to Embodiment 3.

FIG. 18 illustrates the printer 140. In an X-Y-Z coordinate system used in Embodiment 3, a Y direction is a horizontal scanning direction of a serial head 144 as described later and a medium width direction, and an X direction is a vertical scanning direction. Further, a Z direction is a height direction of the printer 140.

The printer 140 includes a housing 141. A main body frame 142 and a transport roller 143 are provided in the housing 141. As an example, the main body frame 142 is formed in a plate shape that extends along an X-Y plane.

Further, the printer 140 includes the serial head 144, a feeding roller 48, a cleaning member 146, a pick-up unit 46, a cam member 148 (see FIG. 20), a first cassette 152, a second cassette 154, a motor unit 156 (see FIG. 19), and a control section 22.

Moreover, in the printer 140, a transport path B for the paper sheet P is formed. The transport path B extends from the first cassette 152 or the second cassette 154 to the outside of the housing 141 via the transport roller 143 and the serial head 144.

The serial head 144 is an example of the recording section, and includes an ink tank (not illustrated) in which the ink is stored. Further, the serial head 144 is configured as a recording head that records various information on the paper sheet P by using the ink supplied from the ink tank.

The feeding roller 48 rotates by receiving a driving force from the motor unit 156, which is an example of the driving section, to feed the paper sheet P toward the transport path B.

Figure 21:
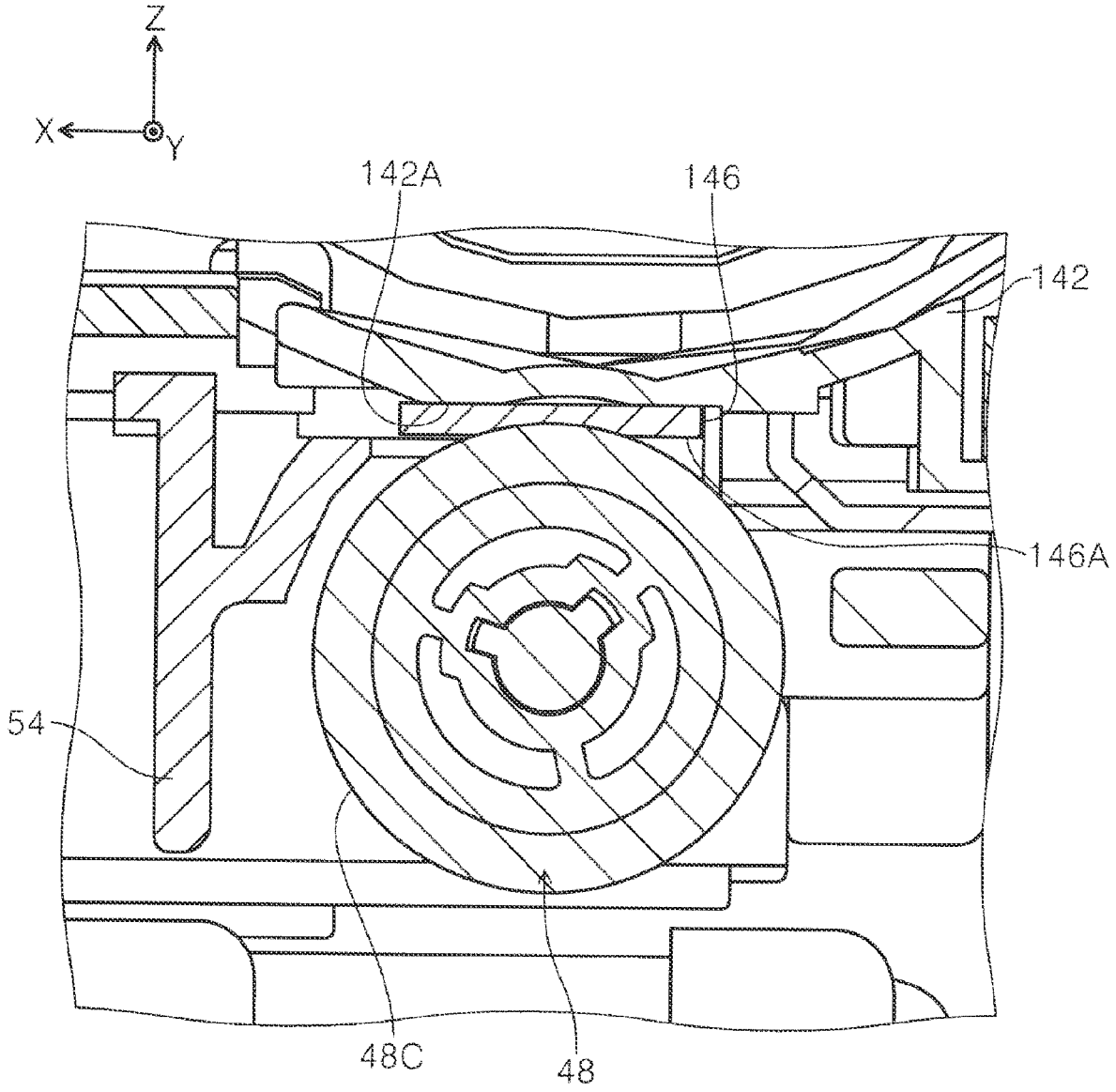
FIG. 21 is a longitudinal cross-sectional view illustrating a state where a cleaning member and a feeding roller of the printer according to Embodiment 3 come into contact with each other.

As illustrated in FIG. 21, the cleaning member 146 is an example of the cleaning section, and is attached to a lower surface 142A of the main body frame 142 at a −X-direction end of the main body frame 142. Further, the cleaning member 146 cleans an outer circumferential surface 48C of the feeding roller 48 by rotation of the feeding roller 48 in a state where a holder 54 is positioned at a cleaning position as described later.

As an example, the cleaning member 146 is formed of urethane and formed in a plate shape having a predetermined thickness in the Z direction. Further, the cleaning member 146 is formed in a rectangular shape of which a dimension in the Y direction is larger than a dimension in the X direction when viewed from the Z direction. A length of the cleaning member 146 in the Y direction is larger than a length of the feeding roller 48 in the Y direction.

A lower surface 146A of the cleaning member 146 in the −Z direction is, for example, a flat surface extending along the X-Y plane. A part of the outer circumferential surface 48C comes into contact with a central portion of the lower surface 146A in the X direction in the +Z direction.

Figure 19:
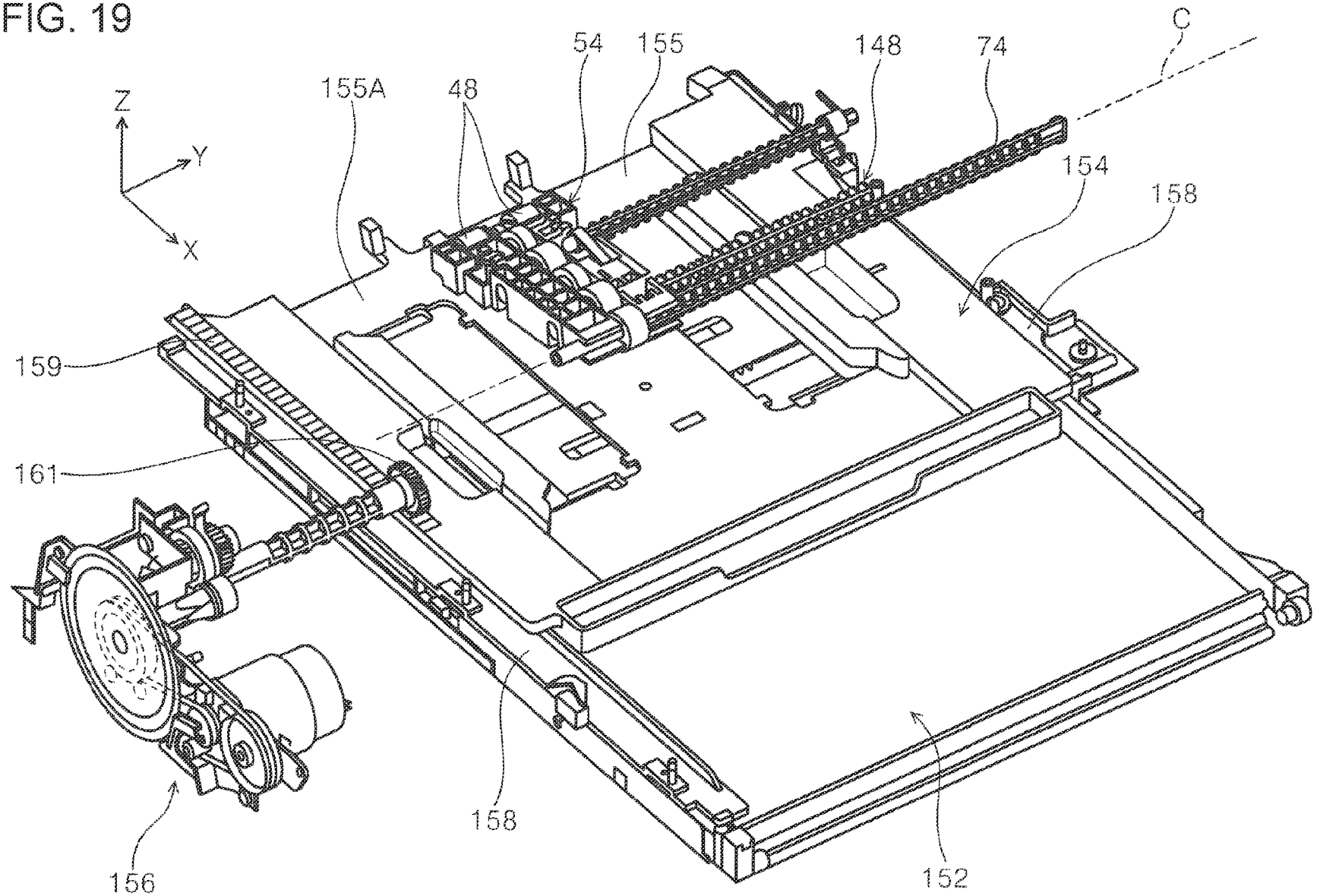
FIG. 19 is a perspective view illustrating a first cassette and a second cassette of the printer according to Embodiment 3.

As illustrated in FIG. 19, a shaft member 47 extends in the Y direction. Opposite ends of the shaft member 47 are rotatably supported by bearings (not illustrated). Here, a central axis of the shaft member 47 that extends in the Y direction is referred to as a virtual axis C, and is indicated by a line C with alternating long and short dashes.

As described above, the holder 54 can independently rotate, regardless of whether or not the shaft member 47 rotates. In other words, the holder 54 is provided so as to be rotatable around the virtual axis C. Further, the other end portion of the holder 54 rotatably supports the feeding roller 48.

As such, the holder 54 is provided so as to be movable between the cleaning position at which the cleaning member 146 (see FIG. 18) can clean the feeding roller 48, and a retreat position at which the cleaning member 146 and the feeding roller 48 are separated from each other. Further, the holder 54 is disposed along the X direction at the cleaning position when viewed from the Y direction. In addition, the holder 54 is disposed in a diagonal direction intersecting the X direction at the retreat position when viewed from the Y direction.

Note that a projecting portion 57 (see FIG. 2) is not formed on the holder 54 in Embodiment 3.

The first cassette 152 is housed at a lower portion of the housing 141 (see FIG. 18), and can accommodate a large-sized paper sheet P. The motor unit 156 is provided in the −Y direction with respect to the first cassette 152. Further, a pair of guide rails 158 is provided in the +Y direction and the −Y direction with respect to the first cassette 152. The pair of guide rails 158 extends in the X direction. Note that the paper sheet P accommodated in the first cassette 152 is sent to the transport path B (see FIG. 18) by a feeding roller (not illustrated).

The second cassette 154 is an example of the mounting section, and is disposed in the +Z direction with respect to the first cassette 152. A length of the second cassette 154 in the Y direction is substantially the same as that of the first cassette 152. A length of the second cassette 154 in the X direction is substantially ⅔ of a length of the first cassette 152 in the X direction. Further, the second cassette 154 can reciprocate in the X direction by being guided by the pair of guide rails 158. Further, the second cassette 154 includes a bottom plate 155 extending along the X-Y plane. A +Z-direction surface of the bottom plate 155 is referred to as an upper surface 155A. The paper sheet P is mounted on the upper surface 155A.

A rack portion 159 extending in the X direction is formed at a −Y-direction end of the bottom plate 155. The rack portion 159 meshes with a driving gear 161. The driving gear 161 rotates by being driven by the motor unit 156.

Figure 20:
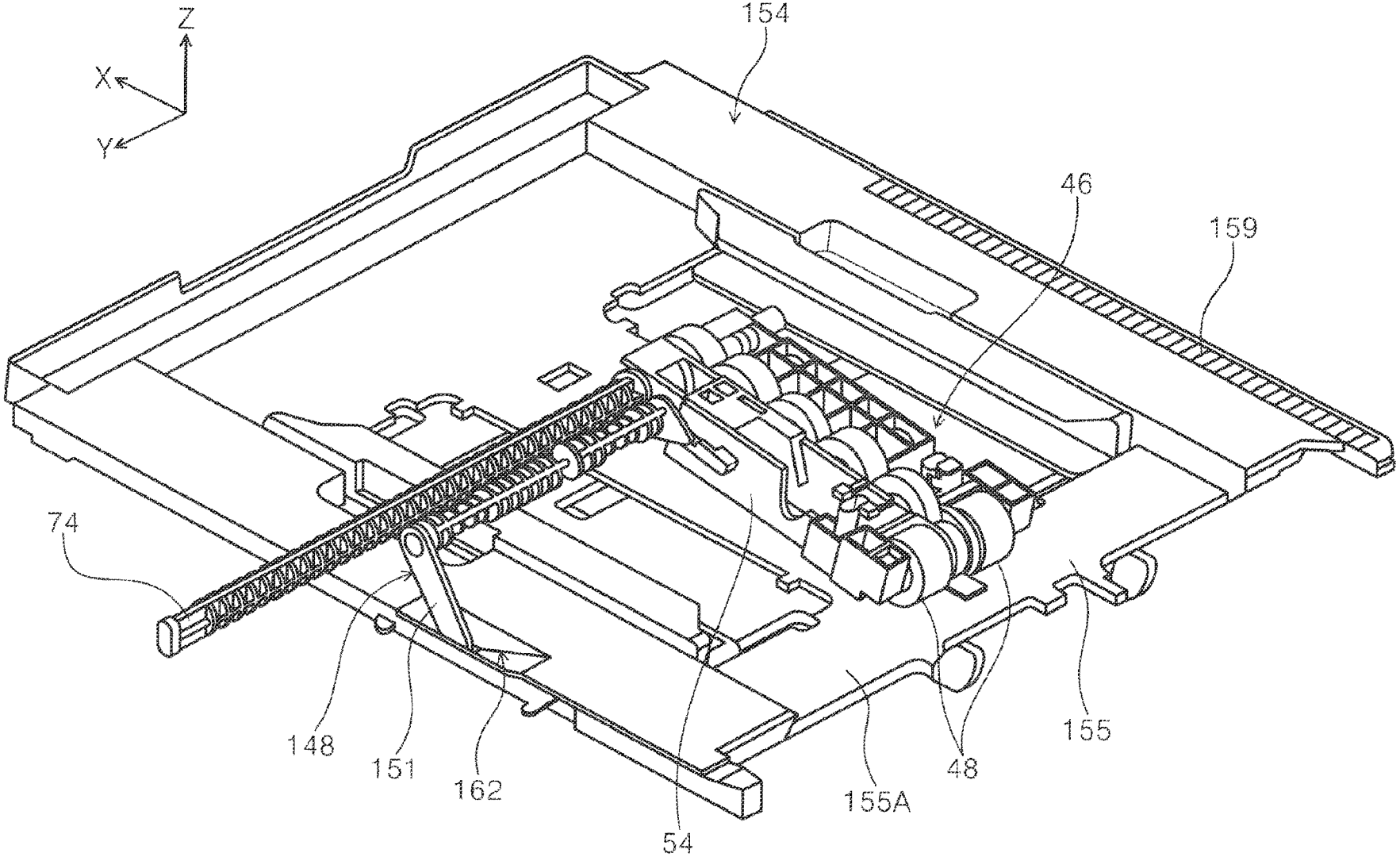
FIG. 20 is a perspective view illustrating the second cassette and a pick-up unit of the printer according to Embodiment 3.

As illustrated in FIG. 20, a recess 162 is formed at a portion that corresponds to a +Y-direction end of the bottom plate 155 and is more toward the +X direction than the center in the X direction is.

The recess 162 is opened in the +Z direction which is an example of the intersecting direction. The recess 162 has a rectangular shape of which a dimension in the X direction is larger than a dimension in the Y direction when viewed from the Z direction. Further, a cam portion 151 as described later comes into contact with the recess 162, thereby rotating the holder 54.

Figure 22:
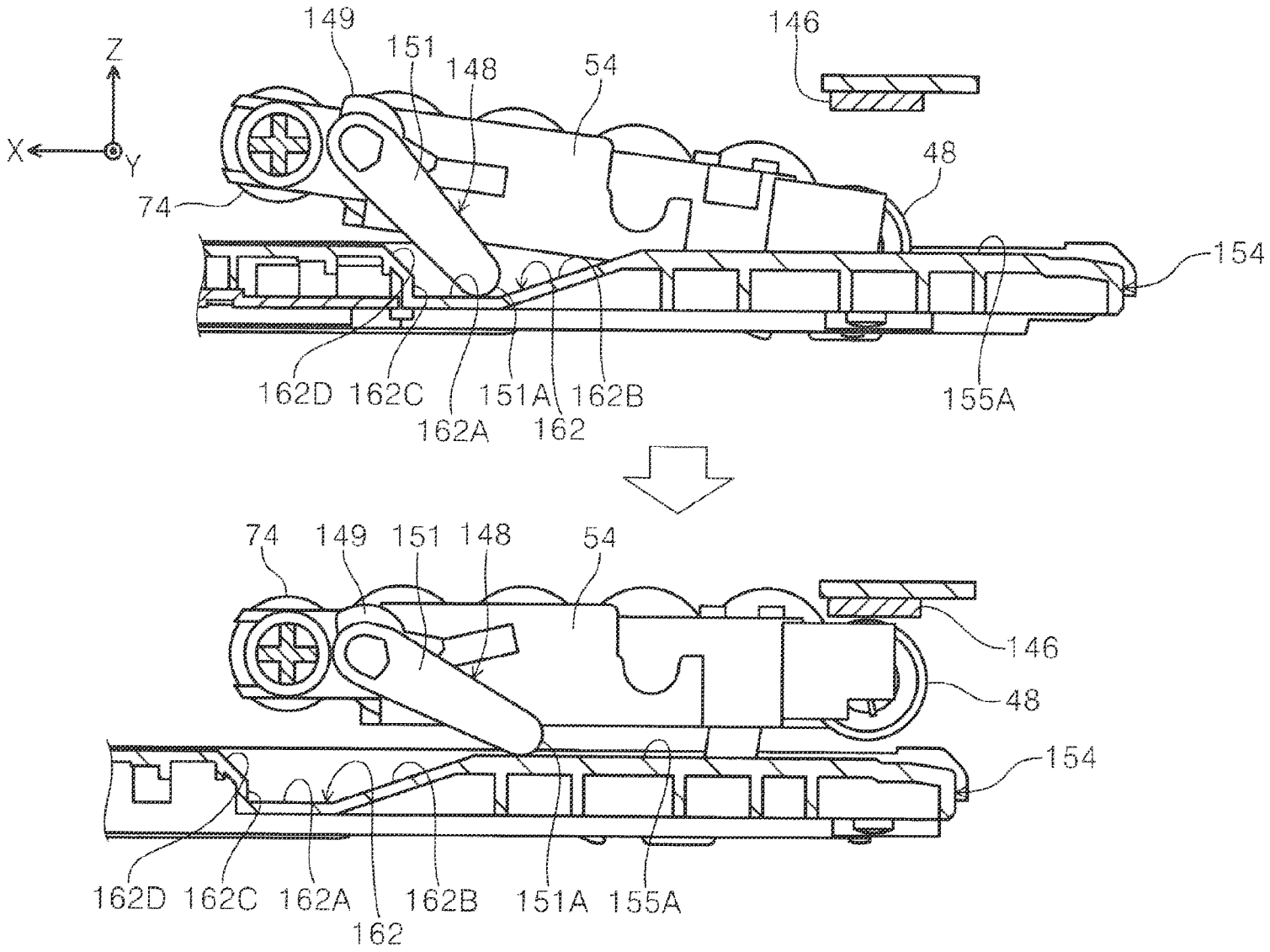
FIG. 22 is a side view illustrating a state where the feeding roller of the printer according to Embodiment 3 is moved to a cleaning position in conjunction with movement of the second cassette.

As illustrated on the upper side of FIG. 22, the recess 162 has a bottom surface 162A, an inclined surface 162B, a vertical surface 162C, and a flank 162D when viewed from the Y direction. The bottom surface 162A is formed along the X direction. The inclined surface 162B is inclined upward in the +Z direction from a +X-direction end of the bottom surface 162A toward the +X direction. The vertical surface 162C stands upright in the +Z direction from a −X-direction end of the bottom surface 162A. The flank 162D is an inclined surface formed to suppress an erroneous movement of the holder 54 that may be caused by a contact between the cam portion 151 as described later and the recess 162 when the holder 54 is positioned at the retreat position.

As an example, the cam member 148 is configured as one member in which a shaft portion 149 and the cam portion 151 are integrated with each other. The shaft portion 149 extends along the +Y direction from a +Y-direction side surface of the holder 54.

The cam portion 151 extends from a +Y-direction end of the shaft portion 149 toward the recess 162. Further, the cam portion 151 is formed in a plate shape having a predetermined thickness in the Y direction. A distal end 151A of the cam portion 151 has a semi-circular shape when viewed from the Y direction.

Here, when the second cassette 154 is positioned in the −X direction, the distal end 151A comes into contact with the bottom surface 162A. In other words, the distal end 151A is positioned in the recess 162. By doing so, the holder 54 is positioned at the retreat position, and feeding of the paper sheet P using the feeding roller 48 can be performed.

As illustrated on the lower side of FIG. 22, when the second cassette 154 is moved in the +X direction, the distal end 151A comes into contact with the upper surface 155A after coming into contact with the inclined surface 162B. Therefore, an angle of a central axis (not illustrated) of the cam portion 151 with respect to the X direction is decreased. That is, the cam portion 151 rotates. By doing so, the holder 54 is positioned at the cleaning position, and cleaning of the feeding roller 48 can be performed.

In Embodiment 3, the second cassette 154 and the cam member 148 are examples of the movement section. In other words, the movement section of Embodiment 3 includes the second cassette 154, and the cam member 148 provided on the holder 54. Note that the cam member 148 may be included in the holder 54.

Actions of the printer 140 of Embodiment 3 will be described with reference to FIGS. 18 to 22. Note that a description of the same actions as those of the printer 10 of Embodiment 1 will be omitted.

In the printer 140, since the position of the holder 54 can be changed by rotating the holder 54 by using the cam member 148, it is possible to further suppress an increase in size of the printer 140 in one direction, as compared with a configuration in which the holder 54 is slid.

Further, in the printer 140, since the recess 162 is formed at the end of the second cassette 154 in the Y direction, it is possible to suppress the paper sheet P from coming into contact with the cam member 148.

Although the example of the recording apparatus according to the present embodiment basically has the above-described configuration, it is a matter of course that partial modification or omission of the configuration can be made without departing from the gist of the present disclosure.

In the printer 10, the main stacker 36 may be configured to slide the holder 54 in the X direction. Magnets may be provided in the main stacker 36 and the holder 54 to move the holder 54 in a non-contact manner by using a repulsive force of the magnets. The cut portion 42 does not have to be formed in the main stacker 36. Instead of the tapered surface 44B, a rotation member such as a roller may be provided at an edge of the cut portion 42. Further, a curved surface may be formed at the edge of the cut portion 42.

The position of the holder 54 may be switched by forming, instead of the recess 162, a protrusion on the second cassette 154 of the printer 140, and bringing the protrusion and the cam portion 151 into contact with each other.

The medium contact section is not limited to the rollers, but may be a member that does not rotate, such as a pressing member that presses a medium. Note that dirt on the medium contact section that needs to be cleaned mainly includes paper dust, silica, or the like derived from a paper sheet, and further includes other dirt such as dust or ink mist.

Examples of a member used in the cleaning section include a cleaning sheet, a cleaning brush, a separation pad, a cleaning rubber roller, a sponge, a member using a conductive material, plain paper, an adhesive sheet, and a film.

A cleaning mode may be selected through a user interface so that the user can specify a flag for switching the position of the support section to the cleaning position. Examples of a time point at which cleaning is automatically performed include a time point at which the cumulative number of printed sheets reaches a predetermined number, a time point at which the number of steps from picking-up of a medium to detection of a rear end of the medium is increased, a time point at which a medium transport time is increased from a predetermined time, a time point at which slipping is detected by a torque sensor, and a time point at which power saving mode is deactivated.

A collection section that collects the dirt cleaned by the cleaning section may be additionally provided. The collection section can be a suction type collection section, an electrostatic attraction type collection section, or the like.

What is claimed is:

1. A recording apparatus comprising:

a medium contact section that is rotatably provided and comes into contact with a medium;

a cleaning section that cleans the medium contact section;

a support section that supports the medium contact section;

a movement section that moves the support section between a cleaning position at which the cleaning section cleans the medium contact section and a retreat position at which the cleaning section and the medium contact section are separated from each other; and a driving section that is configured to perform switching between driving of the medium contact section and driving of the movement section, wherein the driving section rotates the medium contact section when the support section is positioned at the cleaning position.

2. The recording apparatus according to claim 1, wherein the movement section is a mounting section on which the medium is mounted and which is moved in a set direction, and the mounting section switches a position of the support section in an intersecting direction that intersects the set direction by being moved in the set direction.

3. The recording apparatus according to claim 2, wherein the mounting section switches the position of the support section in the intersecting direction by coming into contact with the support section in the set direction.

4. The recording apparatus according to claim 3, wherein the mounting section has a cut portion that is opened in the set direction, and the support section switches the position of the support section in the intersecting direction by coming into contact with an edge of the cut portion.

5. The recording apparatus according to claim 4, wherein a guiding surface that guides the support section in the intersecting direction is formed at the edge of the cut portion.

6. The recording apparatus according to claim 3, wherein the support section is provided so as to be rotatable around an axis extending in a medium width direction intersecting the set direction and the intersecting direction, the movement section includes a cam member provided on the support section, and the mounting section has a recess portion which is opened in the intersecting direction and with which the cam member comes into contact to rotate the support section.

7. The recording apparatus according to claim 6, wherein the recess portion is formed at an end of the mounting section in the medium width direction.

8. The recording apparatus according to claim 1, wherein the support section supports the cleaning section.

9. The recording apparatus according to claim 8, wherein the movement section includes a recording section that performs recording on the medium, and the driving section switches a position of the support section by moving the recording section in the medium width direction.

10. The recording apparatus according to claim 1, further comprising:

a medium detection section that detects whether a failure of transport of the medium occurs; and a control section that controls a switching operation of the driving section, wherein the control section controls the switching performed by the driving section to cause the cleaning section to clean the medium contact section when the medium detection section detects the failure of the transport of the medium.

11. The recording apparatus according to claim 10, further comprising:

a recording section that performs recording on the medium by using an ink supplied from an ink tank; and a time point detection section that detects at least one target time point selected from a time point at which a power supply of the apparatus is turned on or off, a time point at which the ink tank is replaced, and a time point at which the recording on the medium ends, wherein the control section operates the driving section to cause the cleaning section to clean the medium contact section when the time point detection section detects the target time point.

12. The recording apparatus according to claim 1, further comprising:

a recording section that performs recording on the medium by using an ink supplied from an ink tank;

a time point detection section that detects at least one target time point selected from a time point at which a power supply of the apparatus is turned on or off, a time point at which the ink tank is replaced, and a time point at which the recording on the medium ends; and a control section that controls a switching operation of the driving section, wherein the control section operates the driving section to cause the cleaning section to clean the medium contact section when the time point detection section detects the target time point.

13. The recording apparatus according to claim 1, further comprising:

a recording section that performs recording on the medium by using an ink supplied from an ink tank; and a time point detection section that detects at least one target time point selected from a time point at which a power supply of the apparatus is turned on or off, a time point at which the ink tank is replaced, and a time point at which the recording on the medium ends, wherein a control section operates the driving section to cause the cleaning section to clean the medium contact section when the time point detection section detects the target time point.

* * * * *